US010131107B2

(12) United States Patent
Shimizu et al.

(10) Patent No.: US 10,131,107 B2
(45) Date of Patent: Nov. 20, 2018

(54) SHEET PROCESSING DEVICE AND IMAGE FORMING DEVICE PROVIDED WITH THE SAME

(71) Applicants: Daiju Shimizu, Yamanashi-ken (JP); Takashi Saito, Yamanashi-ken (JP); Isao Kondo, Yamanashi-ken (JP)

(72) Inventors: Daiju Shimizu, Yamanashi-ken (JP); Takashi Saito, Yamanashi-ken (JP); Isao Kondo, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 104 days.

(21) Appl. No.: 15/202,010

(22) Filed: Jul. 5, 2016

(65) Prior Publication Data

US 2017/0008723 A1 Jan. 12, 2017

(30) Foreign Application Priority Data

Jul. 6, 2015 (JP) ..... 2015-134847
Jul. 6, 2015 (JP) ..... 2015-134848
Jul. 6, 2015 (JP) ..... 2015-134849

(51) Int. Cl.
*B31F 5/02* (2006.01)
*B65H 37/04* (2006.01)
(Continued)

(52) U.S. Cl.
CPC ..... *B31F 5/02* (2013.01); *B31F 1/00* (2013.01); *B65H 37/04* (2013.01); *B65H 37/06* (2013.01);
(Continued)

(58) Field of Classification Search
CPC ..... B31F 1/00; B31F 5/02; B31F 2201/0712; B65H 37/04; B65H 2301/43828;
(Continued)

(56) References Cited

U.S. PATENT DOCUMENTS 5,615,537 A * 4/1997 Vollenweider ..... B65B 25/14 53/206
7,300,044 B2 * 11/2007 Stemmle ..... G06Q 30/02 270/1.01
(Continued)

FOREIGN PATENT DOCUMENTS

JP 2009-051661 A 3/2009

*Primary Examiner* — Leslie A Nicholson, III
(74) *Attorney, Agent, or Firm* — Manabu Kanesaka

(57) ABSTRACT

The present invention is to provide a sheet processing device including: a receiving tray capable of accommodating therein a sheet having, at a part thereof, a protruding portion and a sheet not having the protruding portion in a mixed state; a first binding member that binds the accommodated sheet bundle at a substantially center thereof in a sheet conveying direction; a folding section that folds the sheet bundle bound by the first binding member in two; and a second binding member that binds protruding portions of the sheet bundle folded by the folding section on a fore edge side of the sheet bundle. With this configuration, the fore edge side of the folded and saddle-stitched sheet bundle can be bound by temporary binding. Thus, a sheet processing device capable of ensuring the security of a saddle-stitched sheet bundle can be provided.

10 Claims, 26 Drawing Sheets

(51) Int. Cl.

| | |
|---|---|
| ***B65H 37/06*** | (2006.01) |
| ***B31F 1/00*** | (2006.01) |
| ***B65H 45/18*** | (2006.01) |
| *G03G 15/00* | (2006.01) |

(52) U.S. Cl.
CPC ..... *B65H 45/18* (2013.01); *B31F 2201/0712* (2013.01); *B65H 2301/43828* (2013.01); *B65H 2301/4505* (2013.01); *B65H 2301/5161* (2013.01); *B65H 2301/51616* (2013.01); *G03G 15/6544* (2013.01); *G03G 2215/00827* (2013.01); *G03G 2215/00831* (2013.01); *G03G 2215/00852* (2013.01)

(58) Field of Classification Search
CPC ..... B65H 2301/51616; G03G 15/6544; G03G 2215/00827; G03G 2215/00831; G03G 2215/00852
USPC ..... 270/37, 58.07, 58.08
See application file for complete search history.

(56) References Cited

U.S. PATENT DOCUMENTS

| | | | | |
|---|---|---|---|---|
| 7,523,593 | B2 * | 4/2009 | Aoyagi | B65H 37/04 270/37 |
| 8,091,881 | B2 * | 1/2012 | Nishimura | G03G 15/6541 270/1.02 |
| 8,205,868 | B2 * | 6/2012 | Kubota | G03G 15/5029 270/58.04 |
| 8,235,375 | B2 * | 8/2012 | Shiraishi | B65H 31/02 270/58.08 |
| 8,342,499 | B2 * | 1/2013 | Shiraishi | B65H 31/3027 270/58.08 |
| 9,352,604 | B2 * | 5/2016 | Kubota | B42B 4/00 |
| 9,555,997 | B2 * | 1/2017 | Yabe | B65H 39/00 |

* cited by examiner

SHEET PROCESSING DEVICE AND IMAGE FORMING DEVICE PROVIDED WITH THE SAME

BACKGROUND OF THE INVENTION

Field of the Invention

The present invention relates to a processing device that binds a sheet bundle carried out from an image forming device such as a copier or a printer and, more particularly, to a technology that prevents the sheet bundle from remaining opened for security purpose.

Description of the Related Art

There are widely known processing devices that align sheets carried out from an image forming device and staple-binds them. Further, there is disclosed a device that temporarily binds the sheet bundle so that others can not easily see contents of the bound sheet bundle.

For example, Jpn. Pat. Appln. Laid-Open Publication No. 2009-51661 discloses a device that staple-binds one end side of a sheet bundle composed of long sheets and short sheets sandwiched between the long sheets and placed on a device tray and half-punches an end portion of the long sheets on an opposite side to the staple-binding portion. When the thus half-punched long sheets are once separated from each other, it is difficult to bind them once again. That is, the half-punch binding can be used as temporary binding for preventing others from easily see contents of the sheet bundle and is effective as a security measure.

However, in the device disclosed in Jpn. Pat. Appln. Laid-Open Publication No. 2009-51661, although the above security measure using the temporary binding can be applied to so-called end surface binding that binds one end of the sheet bundle, it is not applied to so-called saddle-stitching that binds the sheet bundle at its center portion and then folds the bound sheet bundle with the bound portion as a folding position.

SUMMARY OF THE INVENTION

In a first aspect of the disclosure, the following configuration is adopted in order to achieve the object that a security measure is applied also to the saddle-stitched sheet bundle.

That is, there is provided a sheet processing device that binds sheets having different shapes and then folds the sheets, the sheet processing device including: a receiving tray capable of accommodating therein a sheet having a protruding portion at a part thereof and a sheet not having the protruding portion in a mixed state; a first binding member that binds a sheet bundle accommodated in the receiving tray at a substantially center thereof in a sheet conveying direction; a folding section that folds the sheet bundle bound by the first binding member in two; and a second binding member that binds protruding portions of the sheet bundle folded by the folding section on a fore edge side of the sheet bundle.

In a second aspect of the disclosure, there is provided a sheet processing device including: a receiving tray capable of accommodating therein a sheet having, at a part thereof, a protruding portion and a sheet not having the protruding portion in a mixed state; a first binding member that binds a sheet bundle at a substantially center thereof in a sheet conveying direction; a folding section that folds the sheet bundle bound by the first binding member in two; a second binding member that binds protruding portions of the sheet bundle folded by the folding section on a fore edge side of the sheet bundle; a detection member that detects presence/absence of the protruding portion of the sheets to be conveyed to the receiving tray; and a controller that issues an alarm signal when the detection member detects that the sheet having the protruding portion is not accommodated in the receiving tray.

According to the first aspect of the disclosure, the fore edge side of the folded and saddle-stitched sheet bundle can be bound by temporary binding, so that security of even the saddle-stitched sheet bundle can be ensured.

Further, according to the second aspect of the disclosure, it is detected that there is no sheet having the protruding portion that should originally exist before the binding processing, followed by issuance of an alarm signal, so that a more reliable security measure can be taken.

BRIEF DESCRIPTION OF THE DRAWINGS

FIGS. 7A to 7E are explanatory views of operations of the end surface binding stapler unit and end surface pressure-bonding binding unit illustrated in FIG. 2, in which FIG. 7A illustrates a state where long and short sheets are placed, FIG. 7B illustrates a state where end surface binding is performed by the end surface binding stapler unit with the sheet bundle pressed, FIG. 7C illustrates a state where sheet pressing is once released, FIG. 7D illustrates a state where end surface pressure-bonding binding is performed by the end surface pressure-bonding binding unit with the sheet bundle pressed once again, and FIG. 7E illustrates a state where a sheet bundle that has been subjected to the binding by the end surface binding stapler unit and end surface binding stapler unit is discharged;

FIGS. 9A and 9B are explanatory view illustrating a case where the binding is performed by the end surface pressure-bonding binding unit continuously after the binding by the end surface binding stapler unit of FIG. 2, in which FIG. 9A illustrates a case where the pressure-bonding binding is performed without sheet pressing, and FIG. 9B illustrates a case where the pressure-bonding binding is performed with the sheet bundle being pressed;

FIGS. 10A to 10C illustrate different patterns of sheets whose reference side is to be bound by the end surface binding stapler unit and whose leading end side is to be bound by the end surface pressure-bonding binding unit, in which FIG. 10A is a sheet pattern in which the length of the sheet differs from other sheets, FIG. 10B is a sheet pattern in which two tab portions are formed at the leading end side, and FIG. 10C is a sheet pattern in which a protruding portion is formed at four corners;

FIGS. 11A and 11B also illustrate different patterns of sheets, in which FIG. 11A is sheet pattern in which the protruding portion is long in the length direction and short in the width direction, and FIG. 11B is a sheet pattern in which one tab portion is formed at the leading end side;

FIGS. 15A and 15B are explanatory views of folding processing for a sheet bundle saddle-stitched by the sheet processing device illustrated in FIG. 2, in which FIG. 15A is a side view, and FIG. 15B is a plan view;

FIGS. 16A to 16D are explanatory views of a flow of the folding operation illustrated in FIGS. 15A and 15B, in which FIG. 16A illustrates a state before the start of the folding processing at a folding position, FIG. 16B illustrates a state where the folding processing is started, FIG. 16C illustrates a state where the sheet bundle is being folded, and FIG. 16D illustrates a state where the folding processing is nearly completed;

FIGS. 18A to 18D are explanatory views illustrating a state where the fore edge side of a saddle-stitched sheet bundle NTS is subjected to pressure-bonding binding by the folded sheet bundle pressure-bonding binding unit, a bundle pressing roller, and a bundle discharge roller illustrated in FIG. 2, in which FIG. 18A illustrates a state where the saddle-stitched sheet bundle NTS is conveyed to move the fore edge thereof to a position corresponding to the folded sheet bundle pressure-bonding binding unit, FIG. 18B illustrates a state where the folded sheet bundle pressure-bonding binding unit starts the pressure-bonding binding, FIG. 18C illustrates a state where the folded sheet bundle pressure-bonding binding unit is performing the pressure-bonding binding, and FIG. 18D illustrates a state where the folded saddle-stitched sheet bundle NTS is discharged after completion of the pressure-bonding binding by the folded sheet bundle pressure-bonding binding unit;

FIGS. 19A to 19C illustrate different patterns of sheets accumulated in the stacker for being subjected to the saddle-stitching at a substantially center portion by the saddle-stitching stapler unit of FIG. 2 and fore-edge binding by the folded sheet bundle pressure-bonding binding unit, in which FIG. 19A is a sheet pattern of a sheet whose stopper side has tab portions on an outside thereof in the sheet width direction and whose side opposite to the tab portions is long, FIG. 19B is a sheet pattern of a sheet whose both the stopper side and its opposite side have two tab portions on the outside thereof in the sheet width direction, and FIG. 19C is a sheet pattern of a sheet whose stopper side and its opposite side are long in the width direction;

FIGS. 20A and 20B also illustrate different patterns of sheets, in which FIG. 20A is a sheet pattern in which four corners are long, and FIG. 20B is a sheet pattern in which one tab portion is formed on the stopper side and its opposite side;

FIGS. 23A to 23D illustrate a sheet pattern in which a sheet having a tab only on side opposite to the stopper side is inserted every several interleaves, in which FIG. 23A illustrates a state where sheets with no protruding portion are accommodated in the stacker, FIG. 23B illustrates a state where a sheet having a protruding portion protruding from one end is put on the sheet bundle of FIG. 23A, FIG. 23C illustrates a state where a sheet with no protruding portion are put on the sheet bundle of FIG. 23B, and FIG. 23D illustrates a state where a final sheet, which has a protruding portion is put on the sheet bundle of FIG. 23C;

FIGS. 24A and 24B are views illustrating the sheet pattern of FIGS. 23A to 23D, in which FIG. 24A illustrates an accumulation state of the sheet bundle in the stacker, and FIG. 24B is a perspective view of the temporarily-bound sheet bundle;

DESCRIPTION OF THE PREFERRED EMBODIMENTS

Figure 1:
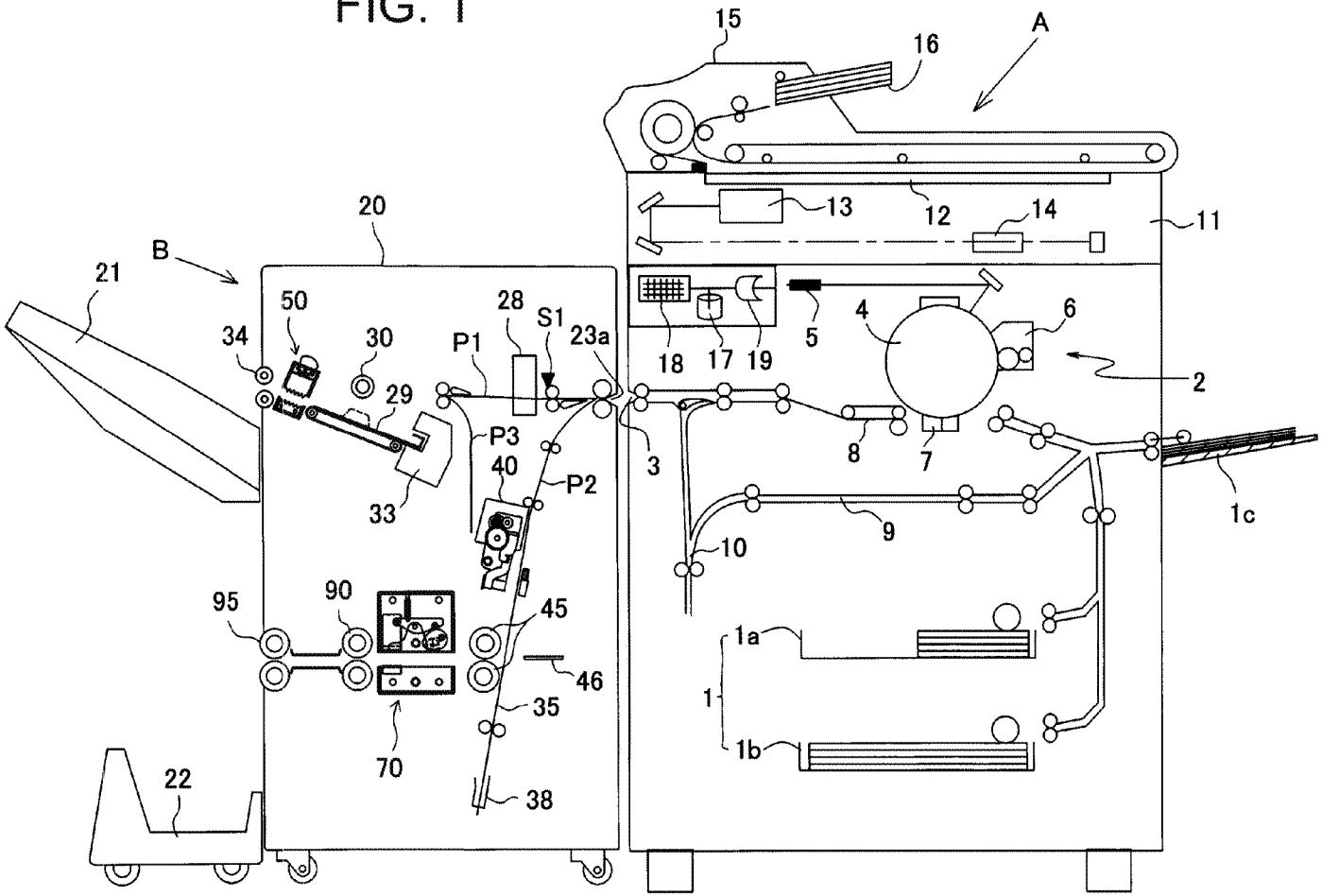
FIG. 1 is an explanatory view illustrating an entire configuration of a system combining an image forming device and a sheet processing device according to the present invention.
Figure 2:
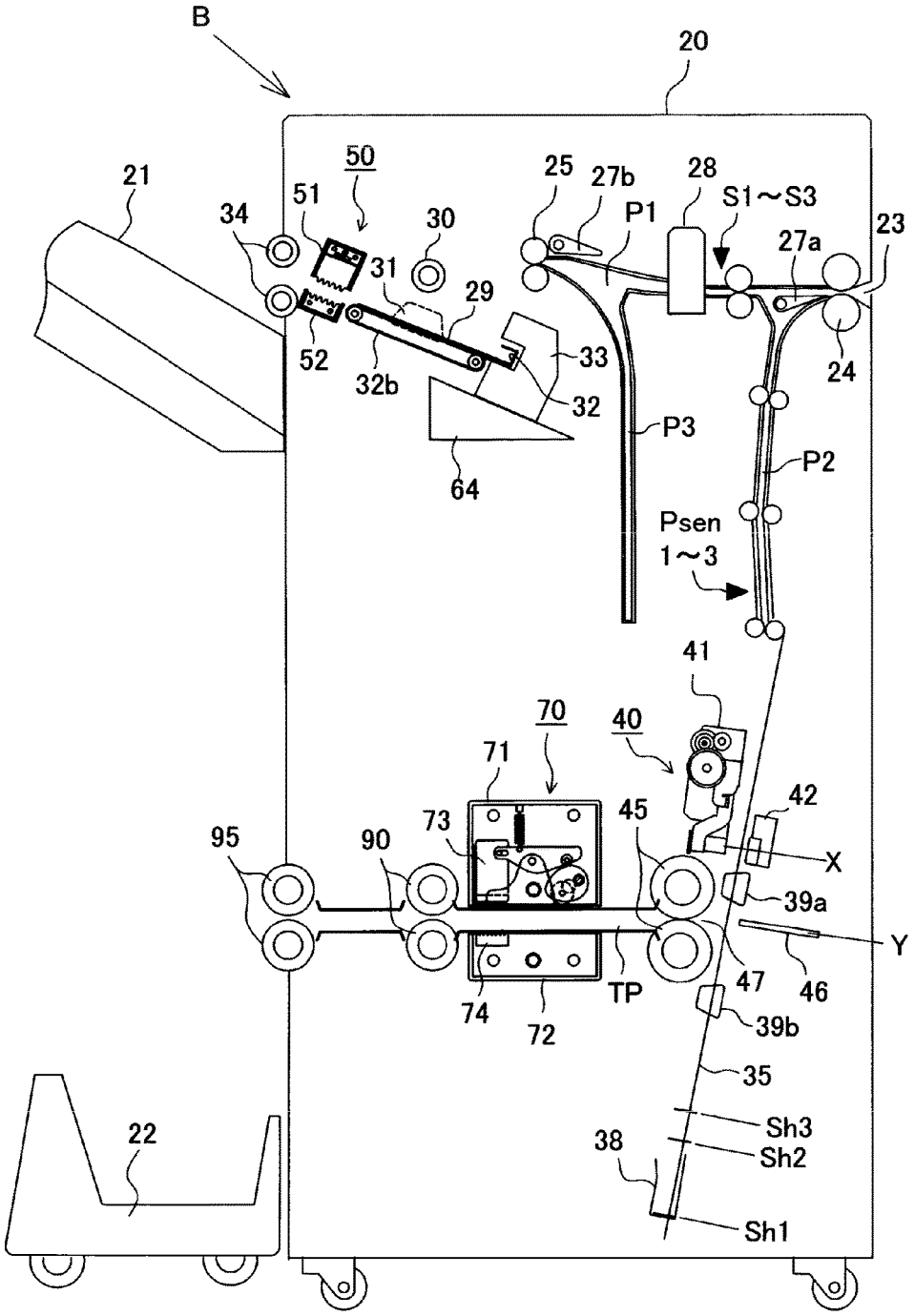
FIG. 2 is an explanatory view illustrating an entire configuration of the sheet processing device according to the present invention provided with an end surface pressure-bonding binding unit and a folded sheet bundle pressure-bonding binding unit.

Hereinafter, the present invention will be described in detail based on illustrated preferred embodiments of the present invention. FIG. 1 is an entire configuration view illustrating an image forming system including an image forming device A and a sheet processing device B according to the present invention, and FIG. 2 is an explanatory view illustrating a detailed configuration of the sheet processing device B.

[Configuration of Image Forming System]

The image forming system illustrated in FIG. 1 includes an image forming device A and a sheet processing device B. A carry-in port 23 of the sheet processing device B is connected to a main body discharge port 3 of the image forming device A, and sheets that have been subjected to image formation in the image forming device A are staple-bound in the sheet processing device B and then accommodated in a first discharge tray 21 or a second discharge tray 22.

[Configuration of Image Forming Device]

The image forming device A will be described based on FIG. 1. The image forming device A feeds a sheet from a sheet supply section 1 to an image forming section 2, performs printing in the image forming section 2, and discharges the sheet from the main body discharge port 3. The sheet supply section 1 accommodates sheets of a plurality of sizes in sheet cassettes 1*a* and 1*b* and separates, one from the other, sheets of a specified size and feeds them one by one to the image forming section 2. A sheet placing table 1*c* that can feed a sheet with tab (to be described later) having a shape in which a part thereof protrudes outward, a sheet having a slightly larger size, or a thick sheet is openably/closably provided to a side of the sheet supply section 1.

The image forming section 2 includes an electrostatic drum 4 and a print head (laser emitter) 5, a developing unit 6, a transfer charger 7, and a fixing unit 8 which are disposed around the electrostatic drum 4. The image forming section 2 forms an electrostatic latent image on the electrostatic drum 4 using the laser emitter 5, the developing unit 6 adds toner to the image, the transfer charger 7 transfers the image onto the sheet, and the fixing unit 8 thermally-fixes the image. The sheets with thus formed image are sequentially carried out from the main body discharge port 3. A reference numeral 9 in FIG. 1 denotes a circulation path, which is a path for two-side printing in which the sheet printed on the front side from the fixing unit 8 is reversed via a main body switchback path 10 and is fed to the image forming section 2 again for printing on the back side of the sheet. The sheet thus printed on both sides is reversed in the main body switchback path 10 and is carried out from the main body discharge port 3.

A reference numeral 11 in FIG. 1 denotes an image reader, where a document sheet set on a platen 12 is scanned by a scan unit 13 and is electrically read by a photoelectric conversion element. This image data is subjected to, e.g., digital processing by an image processing section and is subsequently transferred to a data storage section 14, and an image signal is sent to the laser emitter 5. A reference numeral 15 denotes a document feeder that feeds document sheets accommodated in a document stacker 16 to the platen 12.

Figure 26:
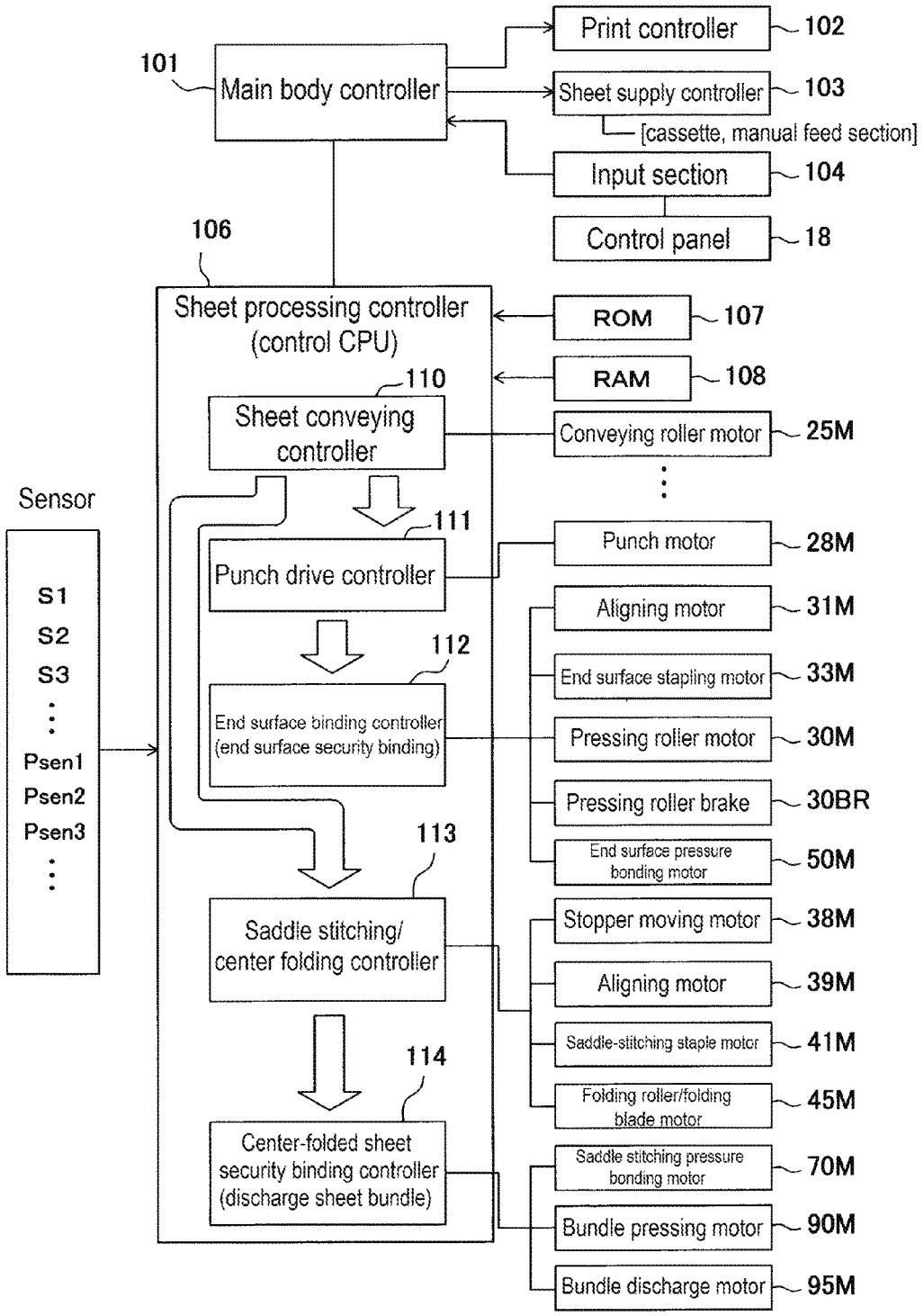
FIG. 26 is an explanatory view of a control configuration in the entire configuration illustrated in FIG. 1.

The image forming device A having the above-described configuration is provided with a main body controller (controller) 101 illustrated in FIG. 26. Image forming conditions are set via a control panel 18, for example, printout conditions such as a sheet size specification, a color or black-and-white printing specification, a print copy count specification, single- or double-side printing specification, and enlarged or reduced printing specification. On the other hand, in the image forming device A, image data read by the scan unit 13 or transferred through an external network is stored in a data storage section 17. The image data stored in the data storage section 17 is transferred to a buffer memory 19, which sequentially transfers data signals to the laser emitter 5.

Simultaneously with the image forming conditions, such as the single- or double-side printing specification, enlarged or reduced printing specification, and color or black-and-white printing specification, post-processing conditions are input and specified via the control panel 18. For example, the post-processing mode includes "printout mode", "staple-binding mode", "security binding mode", "saddle-stitching mode", and "security saddle-stitching mode". Details of these modes will be described later.

[Configuration of Sheet Processing Device]

The sheet processing device B connected to the above-described image forming device A has a punch unit 28 that punches the sheet fed from the carry-in port 23. The punch unit 28 is disposed in the middle of a conveying path extending from a sheet branching section that feeds the sheet from the carry-in port 23 to a saddle-stitching stapler unit 40 to an end surface binding stapler unit 33. Details of these stapler units will be described later.

The sheet processing device B is provided with a first discharge tray 21 disposed on a side surface side of a device frame 20. The first discharge tray 21 is configured to move up and down so as to receive an end surface bound sheet bundle TTS discharged from a processing tray 29.

The sheet processing device B is further provided with a second discharge tray 22 disposed below the first discharge tray 21. The second discharge tray 22 receives, from a bundle discharge roller 95, a saddle-stitched sheet bundle NTS which is a sheet bundle saddle-stitched and folded at a center portion thereof.

There are disposed inside the device frame 20 an end surface binding stapler unit 33 and a saddle-stitching stapler unit 40. The end surface binding stapler unit 33 aligns sheets received from the carry-in port 23 and binds them into the end surface bound sheet bundle TTS. The saddle-stitching stapler unit 40 aligns sheets received from the carry-in port 23 and binds them into the saddle-stitched sheet bundle NTS. A first conveying path P1 is provided between the end surface binding stapler unit 33 and the carry-in port 23, and a second conveying path P2 is disposed between the saddle-stitching stapler unit 40 and the carry-in port 23. Sheets from the carry-in port are sorted into the end surface binding stapler unit 33 side and the saddle-stitching stapler unit 40 side (sheet branching section). In the vicinity of the carry-in port 23, there are disposed a carry-in roller 24, a sheet sensor S1, and a first flapper 27*a* for sorting sheets into the first and second conveying paths P1 and P2.

A buffer path P3 is provided so as to branch off from the first conveying path P1 at a position between the punch unit 28 and the processing tray 29 having the end surface binding stapler unit 33. The buffer path P3 is a path for stacking a predetermined number of sheets received from the carry-in port 23 and then conveys the sheets to the processing tray 29 after a predetermined delay time. To this end, as illustrated in FIG. 2, the buffer path P3 is disposed so as to branch off from the first conveying path P1 in the vertical direction of the device frame 20 on an upstream side in the path reaching the processing tray 29. Then, the sheet from the first conveying path P1 is switched back to be guided to a second flapper 27*b* and made to stay in the buffer path P3.

Accordingly, when the end surface binding is applied to sheets accumulated and aligned in the processing tray 29 to obtain the end surface bound sheet bundle TTS, a subsequent sheet fed to the carry-in port 23 is made to temporarily stay in the buffer path P3 for a predetermined time, and the subsequent sheet in this path can be conveyed to the processing tray 29 after the preceding sheets processed on the processing tray 29 are discharged.

A pressing roller 30 is disposed above the processing tray 29. The pressing roller 30 presses a sheet bundle to be subjected to binding by the end surface binding stapler unit 33 against the processing tray. Further, an end surface pressure-bonding binding unit 50 is disposed between the processing tray 29 and the first discharge tray 21. The pressure-bonding binding unit 50 applies pressure-bonding binding to a protruding portion at a leading end of the end surface bound sheet bundle TTS. Further, a bundle discharge roller 34 is disposed downstream of the pressure-bonding binding unit 50. The bundle discharge roller 34 discharges the end surface bound sheet bundle TTS to the first discharge tray 21.

The first conveying path P1 is disposed in a substantially horizontal direction in an upper portion of a device housing constituted of the device frame 20. The processing tray 29 having the end surface binding stapler unit 33 is disposed downstream of the first conveying path P1, and the first discharge tray 21 is disposed downstream of the processing tray 29.

The second conveying path P2 is disposed in a substantially vertical direction of the device frame 20. A stacker 35 having the saddle-stitching stapler unit 40 is disposed downstream of the second conveying path P2. A bundle conveying path TP is disposed in a direction crossing the stacker 35, and the second discharge tray 22 is disposed at a terminal end of the bundle conveying path TP.

In the second conveying path P2, a folding roller 45 that folds the saddle-stitched sheet bundle NTS in two is provided between the stacker 35 and the second discharge tray 22. In the bundle conveying path TP extending from the folding roller 45, a folded sheet bundle pressure-bonding binding unit 70 that applies pressure-bonding binding to the protruding portion of the saddle-stitched sheet bundle NTS is provided, and a bundle pressing roller 90 that presses the saddle-stitched sheet bundle NTS folded upon the pressure-bonding and a bundle discharge roller 95 that discharges the folded saddle-stitched sheet bundle NTS are provided downstream of the folded sheet bundle pressure-bonding binding unit 70.

[Configuration of End Surface Binding Section]

The following describes an end surface binding section and the pressure-bonding binding unit 50 with reference to FIGS. 3 to 6. The end surface binding section is a section for creating the end surface bound sheet bundle TTS. The pressure-bonding binding unit 50 is provided between the processing tray 29 and the first discharge tray 21 and configured to apply pressure-bonding binding to the leading-end side protruding portion of the end surface bound sheet bundle TTS.

[Structure of Processing Tray]

The processing tray 29 is formed of a synthetic resin plate or the like, and is provided with a sheet support surface to support sheets stacked thereon. The sheet support surface is disposed so as to form a difference in level downstream of a discharge port of a discharge roller 25 and receives and stacks thereon sheets fed by the discharge roller 25.

A sheet end regulating member 32 is provided to the processing tray 29. The sheets discharged from the discharge roller 25 are switched back on the processing tray 29, and leading ends of the switched back sheets are aligned by being hit against the sheet end regulating member 32. Above the processing tray 29, there is provided the pressing roller 30 that conveys the sheet carried in onto the tray to the sheet end regulating member 32.

Further, a side aligning plate 31 is provided on both sides of the pressing roller 30. The side aligning plate 31 is configured to be reciprocable on the processing tray 29 in a sheet width direction. Every time a sheet is carried in onto the processing tray 29, the side aligning plate 31 pushes a sheet side for alignment. Further, there are disposed downstream of the processing tray 29, the pressure-bonding binding unit 50 that applies pressure-bonding binding to the leading end protruding portion of the end surface bound sheet bundle TTS and the discharge roller 34 that discharges the end surface bound sheet bundle TTS to the first discharge tray 21.

Hereinafter, detailed descriptions will be given of main components.

[Configuration of Sheet End Regulating Member]

Figure 3:
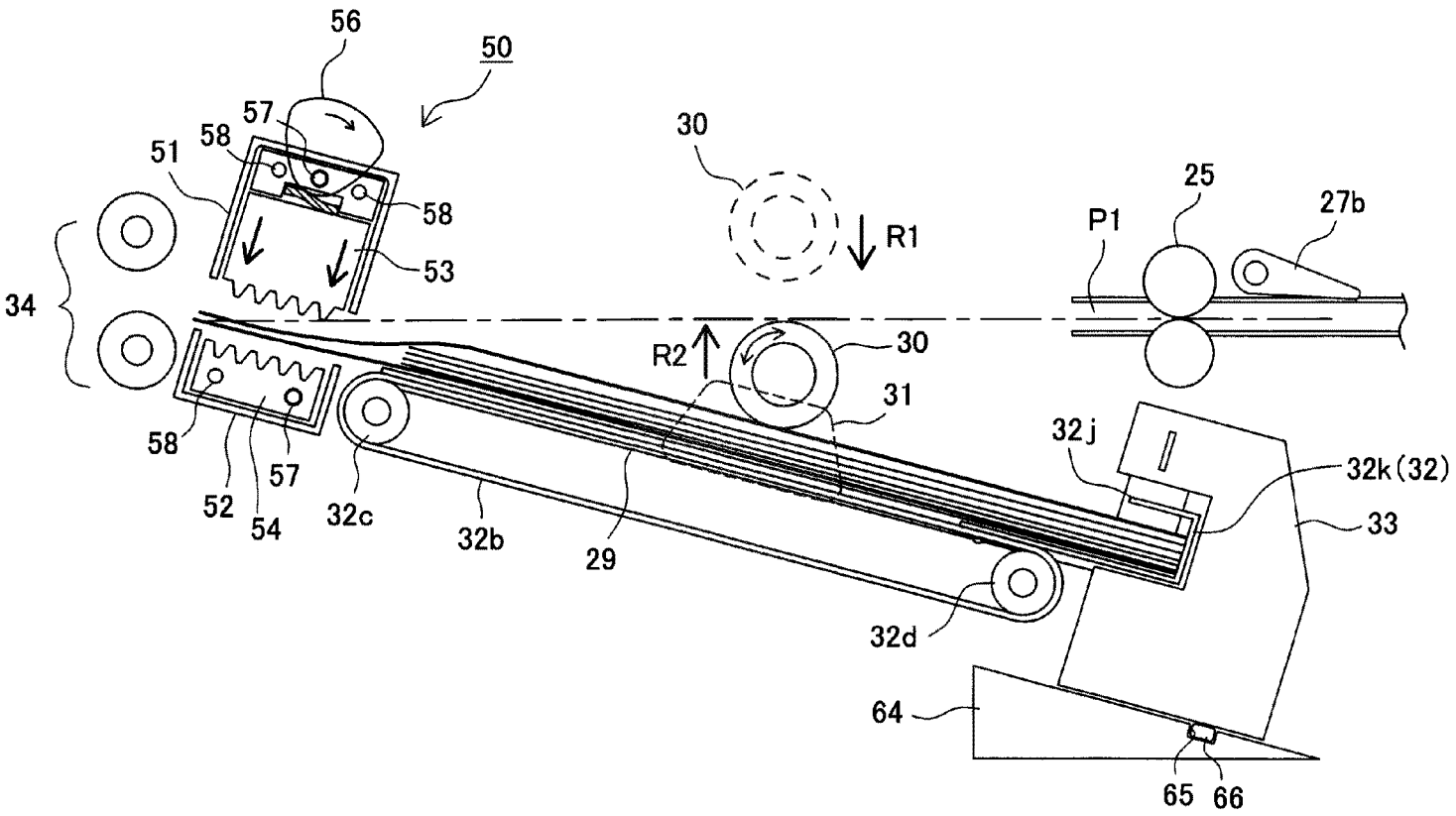
FIG. 3 is a side view illustrating an end surface binding stapler unit and the end surface pressure-bonding binding unit illustrated in FIG. 2.

The sheet end regulating member 32 that positions one end edge of leading and trailing ends of the carried-in sheet is provided to the processing tray 29. The sheet end regulating member 32 illustrated in FIGS. 2 and 3 is constituted of a sheet end surface regulating surface 32*k* that abuts with a rear end edge of sheets for regulation and a sheet top surface regulating surface 32*j* that regulates the position of a top surface of the topmost sheet. The sheet end regulating member 32 is disposed at a rear end edge of the processing tray 29 and abuts with the rear end edge of a sheet conveyed by normal rotation of the pressing roller 30 for regulation to position the sheet at a preset binding position.

[Configuration of Side Aligning Plate]

The side aligning plate 31 that performs sheet side-shift alignment is provided to the processing tray 29. The side aligning plate 31 is moved by an aligning motor 31M. In this alignment, the sheet carried in from the discharge roller 25 to the processing tray 29 is positioned with reference to a center position or with reference to a left or right side edge.

A sheet processing controller (control CPU) 106 may offset the sheets aligned and accumulated in the processing tray 29 by moving the left and right side aligning plate 31 pair in the sheet width direction when the sheets are bound as the end surface bound sheet bundle TTS by the end surface binding stapler unit 33. That is, in this case, unlike a device configuration where the end surface binding stapler unit 33 needs to be moved when the sheet bundle is bound at a corner portion, the sheet bundle can be moved in place of the end surface binding stapler unit 33, thereby achieving miniaturization of the device.

[Configuration of Sheet Bundle Carrying-Out Means]

There is disposed, below the processing tray 29, a carry-out means for carrying out the end surface bound sheet bundle TTS. The carry-out means carries out the end surface bound sheet bundle TTS to its downstream side (the side of the end surface pressure-bonding binding unit 50, bundle discharge roller 34, and first discharge tray 21). In the carry-out means, a part of the sheet end regulating member 32 mentioned above is attached to a reciprocating moving belt 32*b* that is stretched between a discharge side pulley 32*c* and a reference side pulley 32*d* which are provided at a bottom of the processing tray 29. Movement of a part of the sheet end regulating member 32 in a sheet discharge direction moves the end surface bound sheet bundle TTS. Further, in the carry-out means, the pressing roller 30 that presses the sheet on the processing tray 29 is rotated in the discharge direction and discharges the end surface bound sheet bundle TTS in cooperation with a part of the sheet end regulating member 32. Thus, the carry-out means for carrying out the end surface bound sheet bundle TTS is constituted of a part of the sheet end regulating member 32 and the pressing roller 30.

[Configuration of Pressing Roller]

The following describes the pressing roller 30. The pressing roller 30 can be rotated normally and reversely for moving the sheet on the processing tray 29 and can be moved between a pressing position (arrow R1 direction) that presses the sheet on the processing tray 29 and a separation position (arrow R2 direction) for allowing carry-in of the sheet onto the processing tray 29. Every time the sheet is carried in from the discharge roller 25 onto the processing tray 29, the pressing roller 30 is moved from the separation position to the pressing position and rotated in a direction moving the sheet to the sheet end regulating member 32 side.

When the end surface bound sheet bundle TTS bound by the end surface binding stapler unit 33 is carried out to the first discharge tray 21 side, the pressing roller 30 is rotated, at the pressing position, in a direction corresponding to the sheet discharge direction. Further, also when the protruding portion is pressure-bonded by the pressure-bonding binding unit 50 to be described later which is disposed between the processing tray 29 and the first discharge tray 21, the pressing roller 30 is used to press the end surface bound sheet bundle TTS so as to hold the same. When the end surface bound sheet bundle TTS is bound by the pressure-bonding binding unit 50, an electromagnetic brake 30BR provided between the pressing roller 30 and a pressing roller drive motor 30M that drives the pressing roller 30 is activated to prevent movement of the sheet.

[Configuration of End Surface Binding Stapler Unit]

Figure 4:
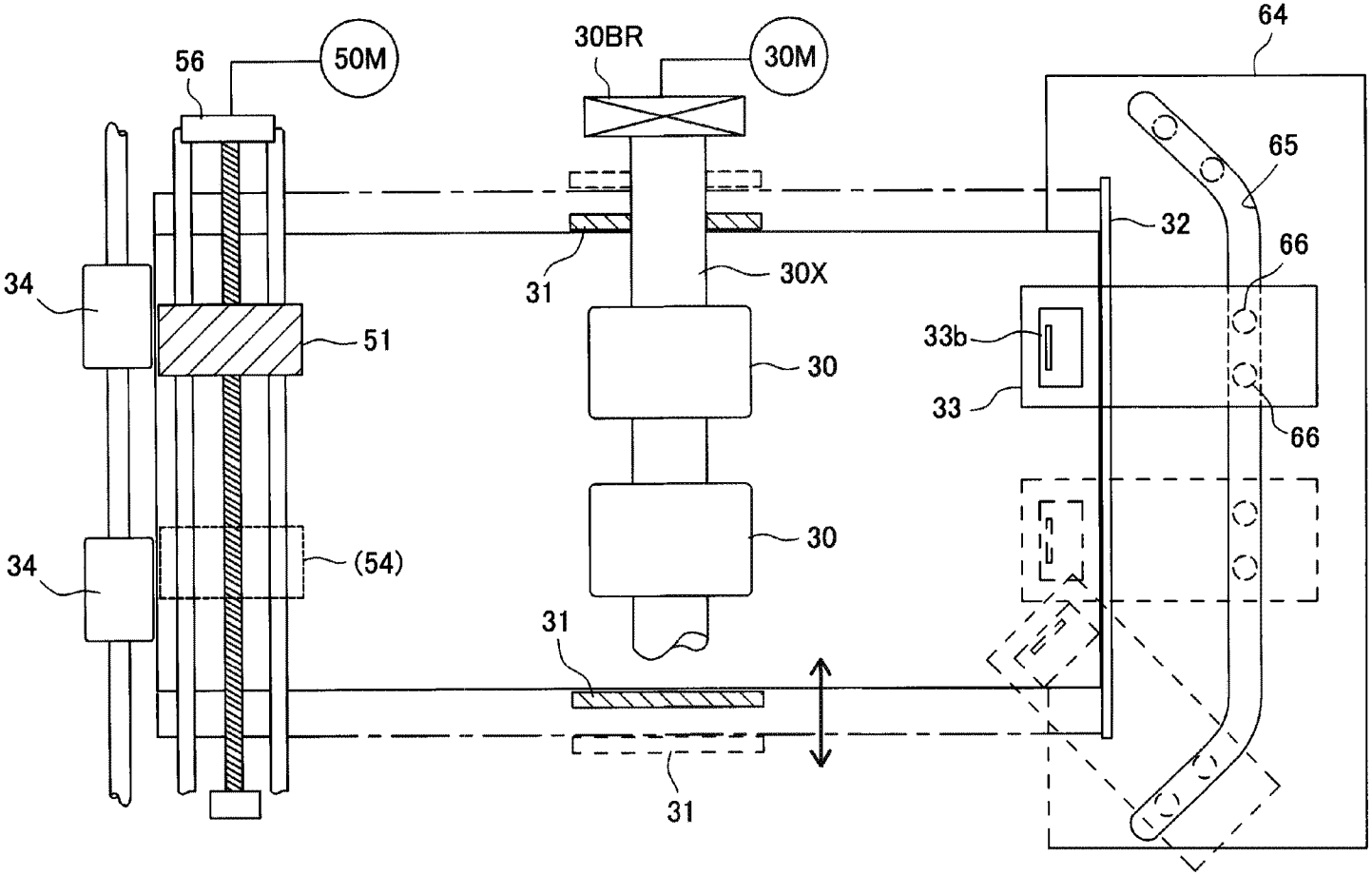
FIG. 4 is a plan view illustrating the end surface binding stapler unit and end surface pressure-bonding binding unit illustrated in FIG. 3.
Figure 5:
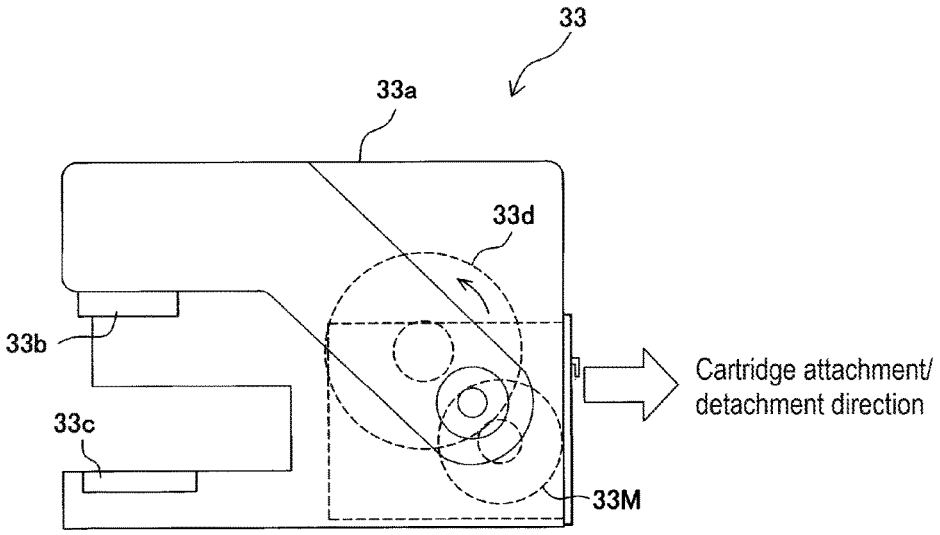
FIG. 5 is an explanatory view illustrating the end surface binding stapler unit illustrated in FIGS. 2 and 3.

As illustrated in FIGS. 3 and 4, the end surface binding stapler unit 33 is movably placed on a slide rail 65 on a slide table 64. Rail fitting pins 66 protruding from a bottom surface of the end surface binding stapler unit 33 are fitted to the slide rail 65 and, in this state, the end surface binding stapler unit 33 is reciprocated in the sheet width direction by an unillustrated moving motor. With the fitting by the fitting pins 66, the end surface binding stapler unit 33 drives a staple needle 33*n* in an inclined fashion at a sheet corner portion.

The end surface binding stapler unit 33 is now widely known as a device that performs sheet binding using a staple. An example of the end surface binding stapler unit 33 will be described based on FIG. 5. The end surface binding stapler unit 33 illustrated in FIG. 5 has a box-shaped unit frame 33*a*, a drive cam 33*d*, and a stapler motor 33M. The drive cam 33*d* is swingably axially supported to the frame 33*a*. The stapler motor 33M is mounted to the frame 33*a* and turns the drive cam 33*d*.

The drive cam 33*d* has a staple head 33*b* and an anvil member 33*c* which are disposed opposite to each other at a binding position. The staple head 33*b* is moved up/down from an upper standby position to a lower staple position (anvil member) by a biasing spring (not illustrated). A needle cartridge 33*f* is detachably attached to the unit frame 33*a*.

Linear blank needles are accommodated in a needle cartridge 33*f* and supplied to the staple head 33*b* by a needle feeding mechanism. The staple head 33*b* incorporates therein a former member that bends the linear needle into a U-like shape and a driver that presses the bent needle into a sheet bundle. With such a configuration, the stapler motor 33M rotates the drive cam 33*d* to press the staple head 33*b* against a top surface of the sheet bundle. Then, when the rotation angle reaches to a predetermined angle, the staple head 33*b* is moved down to the anvil member 33*c* side by the driver. With this operation, the staple needle 33*n* is bent into a U-like shape and then pierced into the sheet bundle. Then, leading ends of the staple needle 33*n* are bent, whereby the sheet bundle is staple-bound.

In the above operation, the drive cam 33*d* is rotated halfway by the stapler motor 33M to press the staple head 33*b* against the sheet bundle, and the stapler motor 33M is stopped at this position, whereby an end portion of the sheet bundle can be held. This holding state can be released by reverse rotation of the stapler motor 33M.

[Configuration of End Surface Pressure-Bonding Binding Unit]

The following describes the end surface pressure-bonding binding unit 50 that binds the sheet bundle placed on the processing tray 29. More specifically, the pressure-bonding binding unit 50 binds protruding portions of topmost and lowermost sheets of the sheet bundle that protrude from document sheets constituting the sheet bundle. The pressure-bonding binding unit 50 is mounted to a discharge side end portion of the processing tray 29 as illustrated in FIGS. 3 and 4 and presses the sheet bundle with a comparatively large force [about 500 kg to 700 kg] from front and back sides of the sheet bundle. A part of the pressure-bonding binding unit 50 that pressure-bonds the sheet bundle is constituted of an end surface upper pressure-bonding tooth part 53 whose leading end has projections and recesses with parallel edge lines and an end surface lower pressure-bonding tooth part 54 having a shape meshing with the leading end of the end surface upper pressure-bonding tooth part 53. The end surface upper pressure-bonding tooth part 53 is moved up and down with respect to the end surface lower pressure-bonding tooth part 54 by an end surface pressure-bonding tooth part moving cam 56 driven by a pressure-bonding motor 50M. Thus, when the end surface upper pressure-bonding tooth part 53 and end surface lower pressure-bonding tooth part 54 mesh with each other with the sheet protruding portions interposed therebetween, fibers of the sheets are entangled to thereby achieve binding of the sheet bundle. This binding force is smaller than that of the staple needle 33*n*, and thus, this process is called "temporary binding" with respect to "proper binding".

Figure 6:
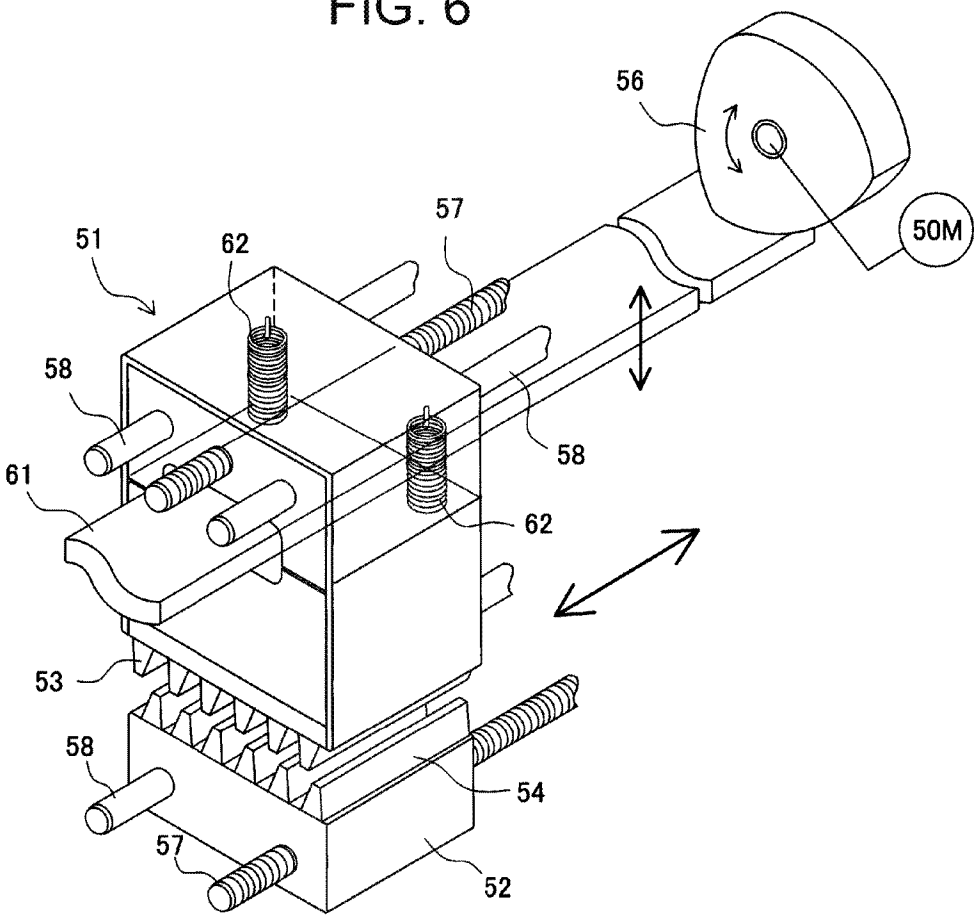
FIG. 6 is a perspective view illustrating the end surface pressure-bonding binding unit illustrated in FIGS. 2 and 3.

A moving mechanism of the end surface pressure-bonding binding unit 50 in the sheet width direction will be described with reference to FIG. 6. In a box-shaped end surface pressure-bonding upper unit 51, the end surface upper pressure-bonding tooth part 53 is positioned below a cam moving plate 61 moved by the end surface pressure-bonding tooth part moving cam 56 and pulled upward by springs 62. Thus, as described above, when the end surface pressure-bonding tooth part moving cam 56 is rotated, the cam moving plate 61 moves downward to cause the end surface upper pressure-bonding tooth part 53 to mesh with the end surface lower pressure-bonding tooth part 54 in an end surface pressure-bonding lower unit 52.

The end surface pressure-bonding upper unit 51 and end surface pressure-bonding lower unit 52 are moved in the sheet width direction synchronously with each other. The end surface pressure-bonding upper unit 51 can be moved by rotation of a lead screw 57 that penetrates a center thereof while being supported by guide rods 58 that penetrate front and rear sides thereof. The end surface pressure-bonding lower unit 52 synchronized with the movement of the end surface pressure-bonding upper unit 51 is also moved in the sheet width direction by the guide rods 58 and lead screw 57. The lead screw is driven by an unillustrated moving motor.

With the above configuration, a rear end side of the sheet bundle placed on the processing tray 29 is bound by the staple needle 33*n* of the end surface binding stapler unit 33 into the end surface bound sheet bundle TTS. Then, the protruding end portions of the end surface bound sheet bundle TTS on the discharge side are temporarily bound by the end surface pressure-bonding binding unit 50, and the resultant end surface bound sheet bundle TTS is discharged onto the first discharge tray 21 by the discharge roller 34.

In the above illustrative embodiment, the end surface pressure-bonding upper unit 51 and end surface pressure-bonding lower unit 52 are moved in the sheet width direction; however, a configuration may be adopted, in which only the end surface pressure-bonding upper unit 51 is moved in the sheet width direction, and the end surface pressure-bonding lower unit 52 is fixedly provided at a plurality of specified locations. Alternatively, both the end surface pressure-bonding upper unit 51 and end surface pressure-bonding lower unit 52 may be fixedly provided at a plurality of locations in the sheet width direction.

[Operation of End Surface Binding]

Figure 7A:
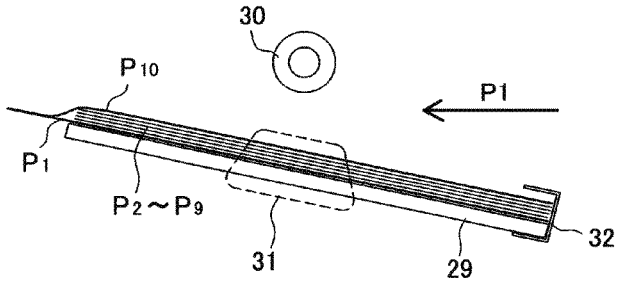
Figure 7B:
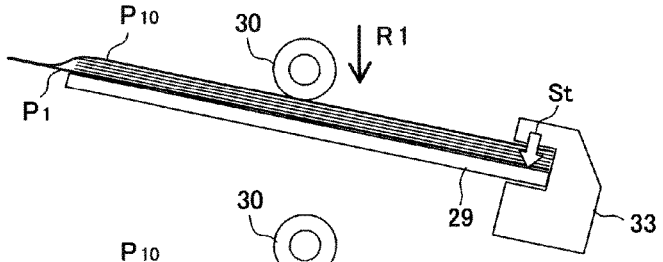
Figure 7C:
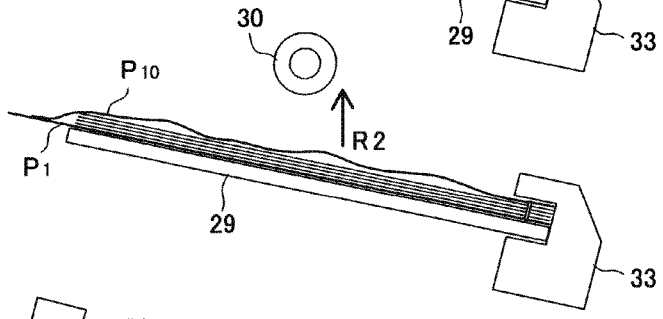
Figure 7D:
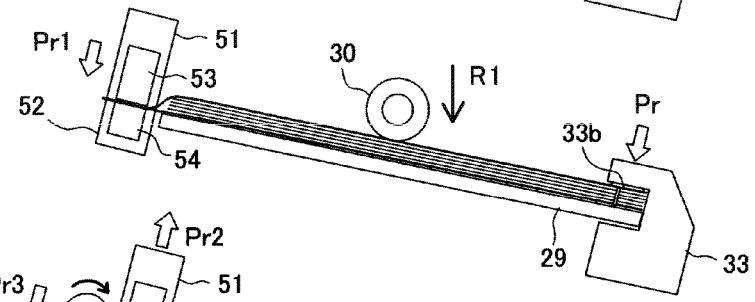
Figure 7E:
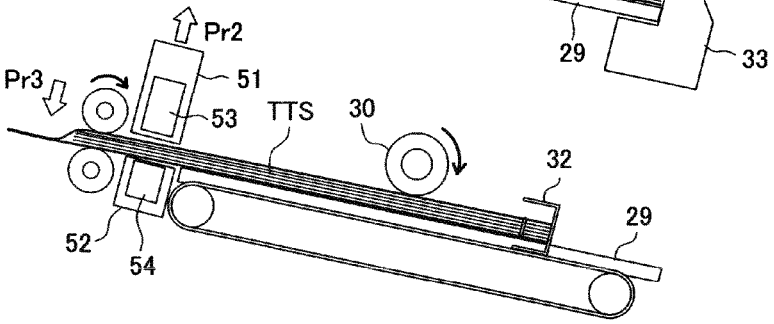
Figure 8:
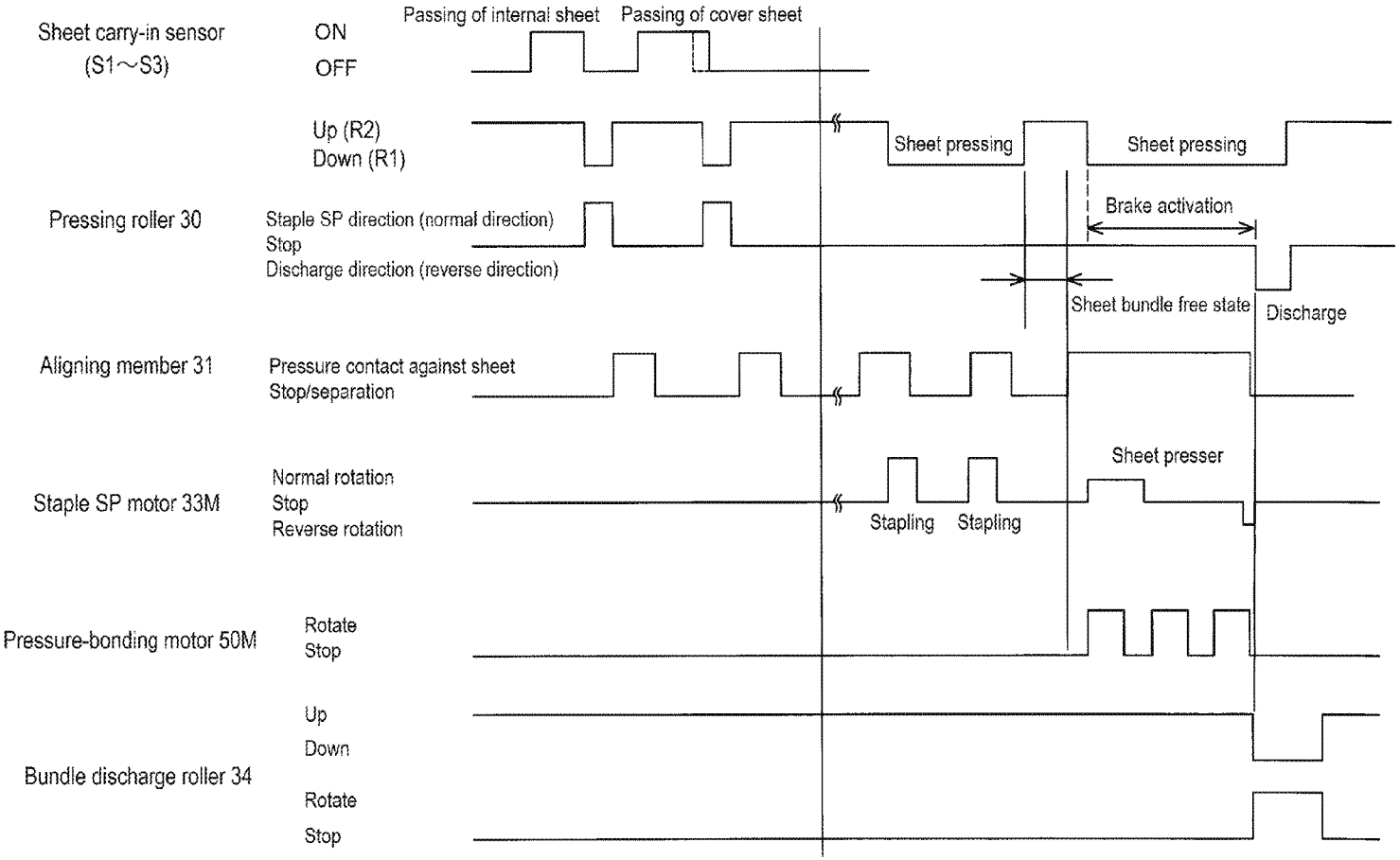
FIG. 8 is a timing chart of the binding performed by the end surface binding stapler unit and end surface pressure-bonding binding unit.

The following describes, with reference to FIGS. 7A to 7E and a timing chart of FIG. 8, a binding operation of the end surface binding stapler unit 33 that binds the sheet bundle end portion using the staple needle 33*n* and a binding operation of the end surface pressure-bonding binding unit 50 that pressure-bonding binds the protruding portions of long sheets. The operation of the end surface pressure-bonding binding unit 50 is to temporarily bind the sheets to prevent others from seeing the contents of the end surface bound sheet bundle TTS. This temporary binding is performed in a security mode to be described later.

FIG. 7A illustrates a state where long and short sheets are placed on the processing tray 29. Up to this state, the pressing roller 30 is moved between the pressing position (arrow R1 direction) and the separation position (arrow R2 direction) every time the sheet is carried in by the discharge roller 25. In this state, the pressing roller 30 is rotated in a direction that feeds the sheet to the sheet end regulating member 32 side. Further, the side aligning plate 31 is reciprocated in the sheet width direction synchronously with the carry-in of the sheet to align the sheet bundle with reference to a center of the processing tray 29 in the width direction.

In FIGS. 7A to 7E, 10 sheets are assumed to be placed on the processing tray 29. A first sheet (P1) and a 10-th sheet (P10) are longer in a sheet conveying direction, and the second to ninth sheets (P2 to P9) between the first and 10-th sheets are shorter in the conveying direction. A sheet protruding pattern will be described later. The long and short lengths of the sheets are detected by three sensors (S1, S2, and S3, see FIG. 2) disposed in the width direction. When the long sheet is carried in, any one of or all the sensors are turned ON, whereby it is possible to confirm carry-in of a long or short sheet onto the processing tray 29.

As illustrated in FIG. 7B, after completion of placement of the 10 long and short sheets, the side aligning plate 31 presses side edges of the sheet bundle, and the pressing roller 30 is moved from the separation position to the pressing position (arrow R1 direction) to press the sheet bundle against the processing tray 29. As a result, the sheet bundle is aligned and position-fixed. In this state, the end surface binding stapler unit 33 is moved from its home position to a specified needle driving position, and the stapler motor 33M is driven to drive the staple needle 33*n* into the sheet bundle. Subsequently, the end surface binding stapler unit 33 is moved to a next needle driving position, and the stapler motor 33M is driven once again to drive the staple needle 33*n* into the sheet bundle. As a result, the staple needle 33*n* is driven at two locations on the sheet end regulating member 32 side, whereby the end surface bound sheet bundle TTS is obtained. Here, one normal rotation of the stapler motor M33 allows the end surface pressure-bonding tooth part moving cam 56 to achieve the needle driving.

Then, as illustrated in FIG. 7C, the pressing roller 30 is once moved from the pressing position to the separation position (arrow R2 direction) to release the restrained state of the sheet bundle. This operation is performed for removing wrinkles of a cover or the like of the sheet bundle caused due to binding operation; however, in a case where the binding is applied to a sheet that is unlikely to have wrinkles, such as a thick paper, the separating operation of the pressing roller 30 need not be performed before the subsequent pressure-bonding binding processing.

Further, in the present embodiment, the end surface bound sheet bundle TTS is not moved upon the pressure-bonding binding; however, when the sheet size is small, the pressing roller 30 is moved to the separation position so that a part of the sheet end regulating member 32 can be moved in the sheet discharge direction.

Then, as illustrated in FIG. 7D, the pressing roller 30 that has once been moved to the separation position is moved to the pressing position (arrow R1 direction), and the electromagnetic brake 30BR is activated to regulate rotation of the pressing roller 30 to constrain the sheet bundle. Further, in the present embodiment, the stapler motor 33M of the end surface binding stapler unit 33 is driven until the staple head 33*b* is positioned at the pressing position to thereby hold the sheet bundle. In this case, the rotation of the stapler motor 33M is less than one rotation, so that the staple head 33*b* does not drive the needle. The pressure-bonding binding is performed by the end surface pressure-bonding binding unit 50 in this state. That is, the end surface pressure-bonding upper unit 51 and end surface pressure-bonding lower unit 52 are moved to a specified pressure-bonding position by rotation of the lead screw 57. When the pressure-bonding motor 50M is driven at the pressure-bonding position, the end surface upper pressure-bonding tooth part 53 and end surface lower pressure-bonding tooth part 54 mesh with each other to pressure-bond the protruding portions of the end surface bound sheet bundle TTS to thereby temporarily bind the end surface bound sheet bundle TTS.

Here, with reference to FIGS. 9A and 9B, a series of operations in which the pressure-bonding binding is performed after pressing the end surface bound sheet bundle TTS by the pressing roller 30 will be described. For comparison, a case where the pressure-bonding binding is performed without sheet pressing (FIG. 9A) and a case where the pressure-bonding binding is performed by the end surface pressure-bonding binding unit 50 with the sheet bundle being pressed (FIG. 9B) will be described.

Figure 9A:
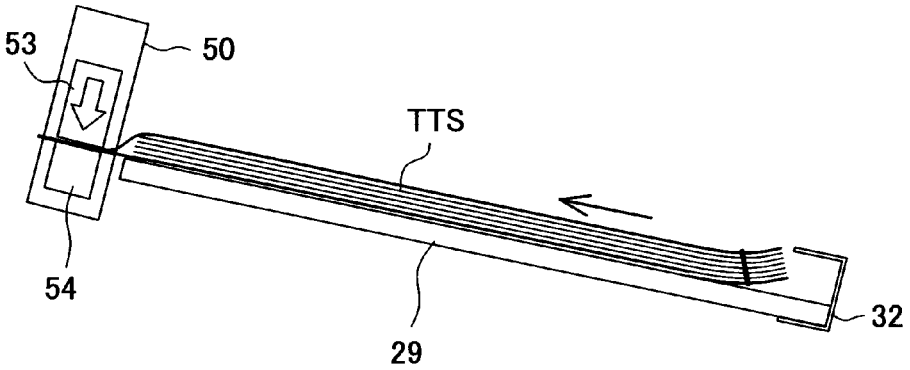

As illustrated in FIG. 9A, when the pressure-bonding binding is performed by the end surface pressure-bonding binding unit 50 without sheet pressing, a level difference occurs between the protruding portions of the long sheets when the sheet bundle is composed of a comparatively large number of sheets. When the pressure-bonding binding is performed in this state, the top long sheet is pulled by the end surface pressure-bonding binding unit 50 to lift the rear end of the end surface bound sheet bundle TTS bound by the staple needle 33*n*, with the result that the sheet bundle TTS may be deformed to have a curved shape. If the pressure-bonding binding is continued in this state, a curved end surface bound sheet bundle TTS may be produced. Particularly, in the pressure-bonding binding, the pressure-bonding tooth parts have mutually meshing projections and recesses, so that the sheet may be caught by the tooth parts, and when the binding is performed with the sheet pulled by the tooth parts, the entire sheet bundle may easily be curved, resulting in a bad appearance. Further, there may be a case where the sheet bundle cannot be discharged outside properly due to the curvature.

Figure 9B:
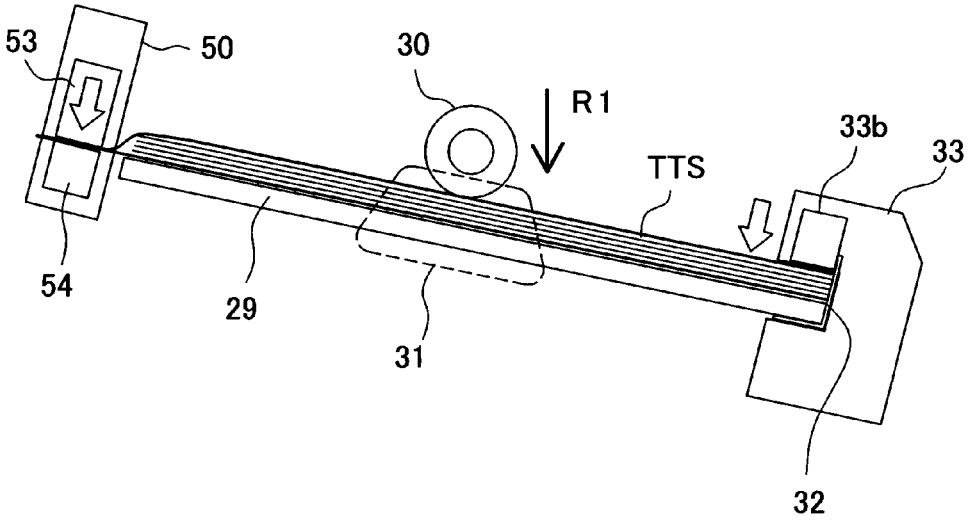

To cope with this, in FIG. 9B, the pressing roller 30 that has once been moved to the separation position is moved to the pressing position (arrow R1 direction) to press the end surface bound sheet bundle TTS whose rear end side has been staple-bound, and then the end surface binding stapler unit 33 is used to perform the pressure-bonding binding. With this operation, it is possible to pressure-bond the protruding portions each other while suppressing a displacement or curvature from occurring in the end surface bound sheet bundle TTS.

Further, in FIG. 9B, in addition to pressing by the pressing roller 30, the staple head 33*b* presses the sheet bundle in a range where the needle is not driven by the end surface binding stapler unit 33. Thus, the end surface bound sheet bundle TTS is pressed by the pressing roller 30 and the staple head 33*b* of the end surface binding stapler unit 33 at a substantially center position and a rear end position thereof, respectively, so that it is possible to achieve the pressure-bonding binding without generating a displacement and curvature in the end surface bound sheet bundle TTS.

In the manner as described above, the proper binding (staple binding by the end surface binding stapler unit 33) and temporary binding (pressure-bonding binding by the end surface pressure-bonding binding unit 50) can be applied to the sheets carried in onto the processing tray 29, whereby a bound booklet with ensured security can be provided.

Some sheet patterns to which the above proper and temporary binding can be applied will be described with reference to FIGS. 10A to 10C and FIGS. 11A and 11B. FIGS. 12A to 12C and FIGS. 13A and 13B are perspective views illustrating booklets as products obtained by applying the proper and temporary binding to the respective sheet patterns.

[Sheet Pattern Having Protruding Portion]

FIGS. 10A to 10C and FIGS. 11A and 11B illustrate different types of sheet patterns. More specifically, FIGS. 10A to 10C and FIGS. 11A and 11B each illustrate a pattern of the protruding portion of the long sheet constituting the end surface bound sheet bundle TTS placed on the processing tray 29. In the drawings, a reference side (sheet end regulating member 32 side on which the end surface bound sheet bundle TTS is staple-bound by the end surface binding stapler unit 33) of the end surface bound sheet bundle TTS is the lower side, and the side on which the leading end of the end surface bound sheet bundle TTS is bound by the end surface pressure-bonding binding unit 50 is the upper side. As illustrated, with the left and right sides of the end surface bound sheet bundle TTS aligned by the side aligning plate 31, the lower side of the end surface bound sheet bundle TTS is staple-bound by the staple needle 33*n*, and the upper side protruding portion TTSH of the end surface bound sheet bundle TTS is subjected to pressure-bonding binding SAH.

Figure 10A:
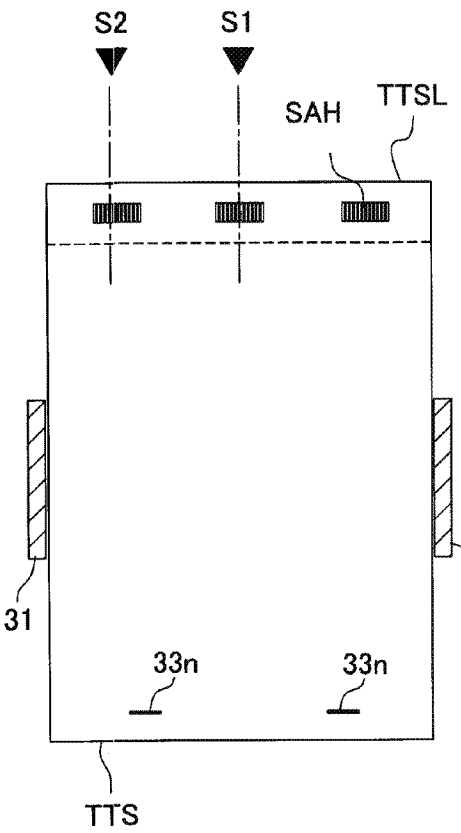

FIG. 10A is a sheet pattern in which the length of the sheet differs from other sheets, wherein a protruding portion TTSL extends in the sheet width direction, and the pressure-bonding binding SAH is applied to three locations of the protruding portion TTSL. In this case, a booklet of an end surface bound sheet bundle TTS illustrated in FIG. 12A in which the entire region of the sheet leading end side is covered by the temporarily bound protruding portion TTSL is obtained.

The sensors S1 to S3 are disposed spaced apart from one another in the sheet width direction and detect the length of the sheet passing therethrough. Thus, whether the sheet carried in onto the processing tray 29 is a short sheet or a sheet having the protruding portion (TTSL or TTS-TAB) can be detected.

Figure 10B:
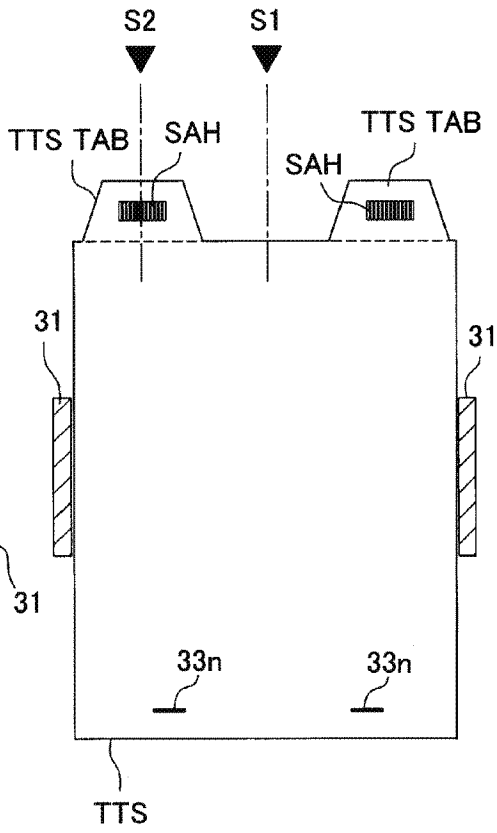
Figure 12A:
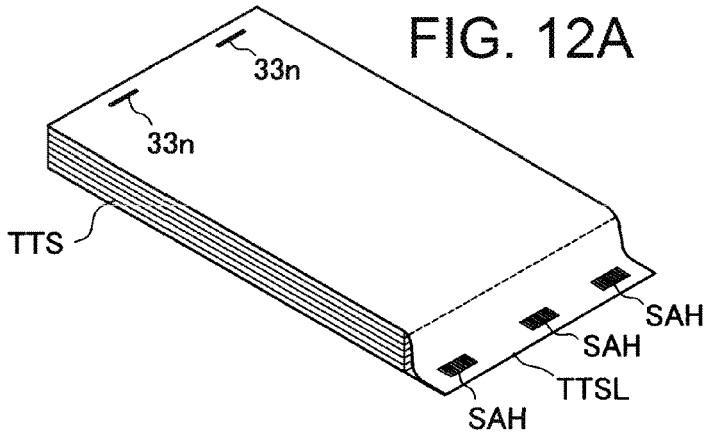
FIGS. 12A to 12C are perspective views of temporarily-bound sheet bundles having the patterns of FIGS. 10A to 10C, in which FIGS. 12A, 12B, and 12C correspond to FIGS. 10A, 10B, and 10C, respectively.
Figure 12B:
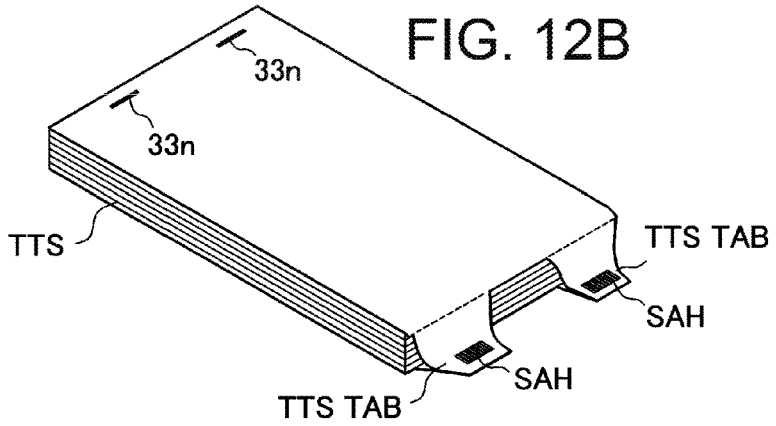

FIG. 10B is a sheet pattern in which a tab-shaped protruding portion (TTS-TAB) is formed at two locations of an upper portion of the end surface bound sheet bundle TTS. The pressure-bonding binding SAH is applied to the tab portions. In this case, a booklet of an end surface bound sheet bundle TTS with tab illustrated in FIG. 12B is obtained.

Figure 10C:
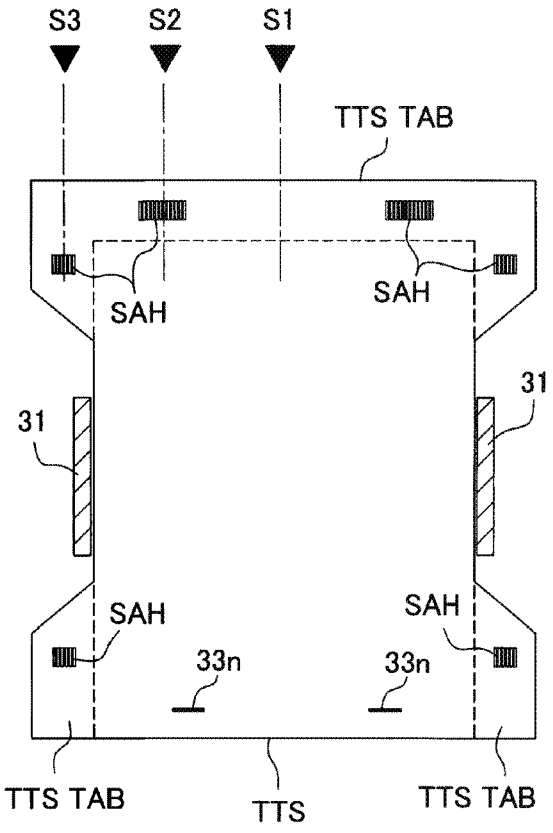
Figure 12C:
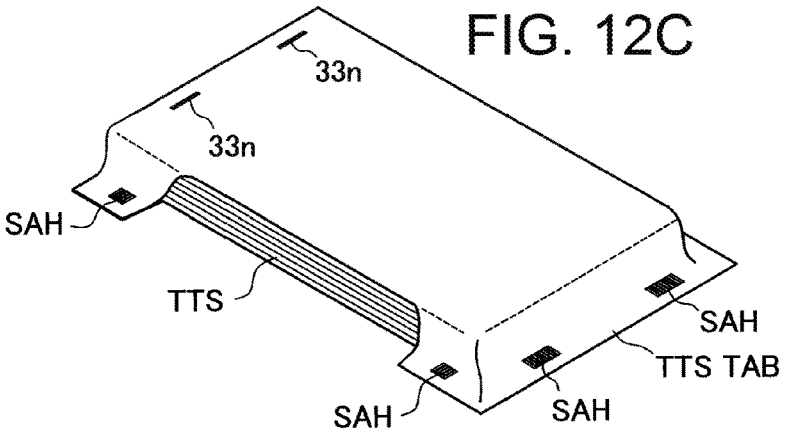

FIG. 10C is a sheet pattern in which the tab-shaped protruding portion (TTS-TAB) is formed so as to protrude both in the upper direction and sheet width direction. In addition, at the lower side of the end surface bound sheet bundle TTS, the tab-shaped protruding portion (TTS-TAB) protrudes in the sheet width direction. As a result, the end surface bound sheet bundle TTS of FIG. 10C has a protruding portion of a comparatively wide range. The pressure-bonding binding SAH is applied to the tab portions and, in this case, a booklet of an end surface bound sheet bundle TTS with tab illustrated in FIG. 12C is obtained.

The tab is not formed at a part of the end surface bound sheet bundle TTS that is pressed by the side aligning plate 31 so that both the long and short sheets can be aligned.

Figure 11B:
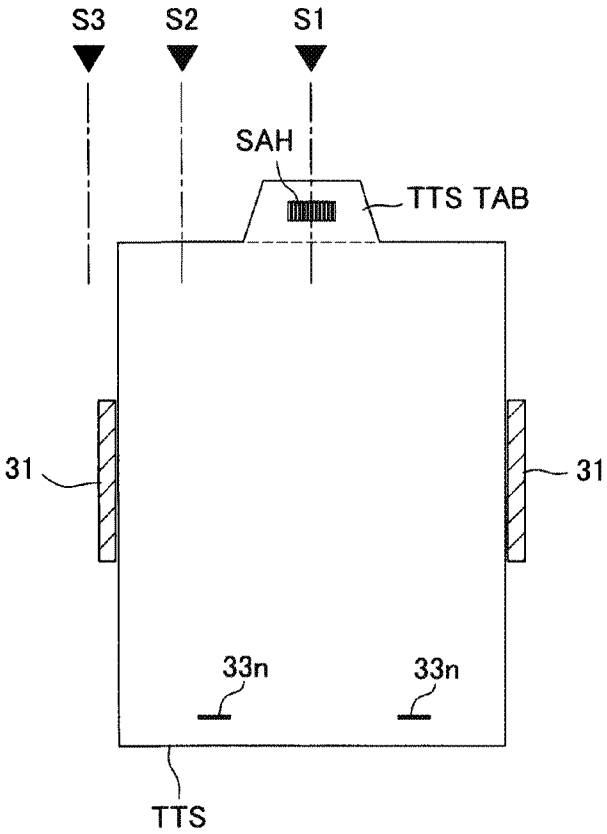
Figure 11A:
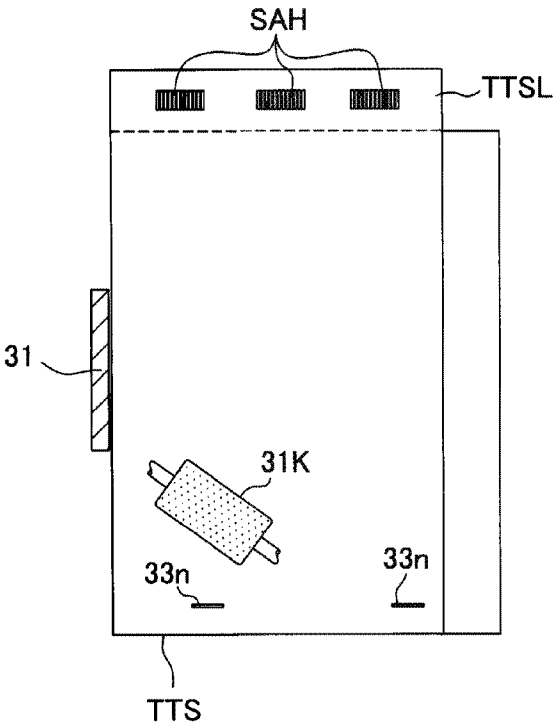
Figure 13A:
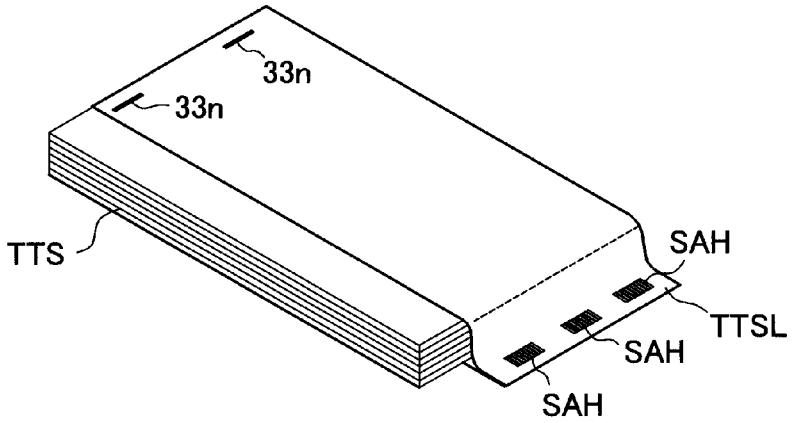
FIGS. 13A and 13B are perspective views of temporarily-bound sheet bundles having the patterns of FIGS. 11A and 11B, in which FIGS. 13A and 13B correspond to FIGS. 11A and 11B, respectively.

FIG. 11A is a sheet pattern in which the protruding portion (TTSL) is long in the sheet conveying direction but short in the sheet width direction. When the end surface bound sheet bundle TTS with such a tab is aligned, an inclined roller 31*k* is used. The inclined roller 31*k* is provided at one corner of the sheet end regulating member 32 side and configured to be rotated every time the sheet is carried in. In this case, a booklet of an end surface bound sheet bundle TTS with tab illustrated in FIG. 13A is obtained.

Figure 13B:
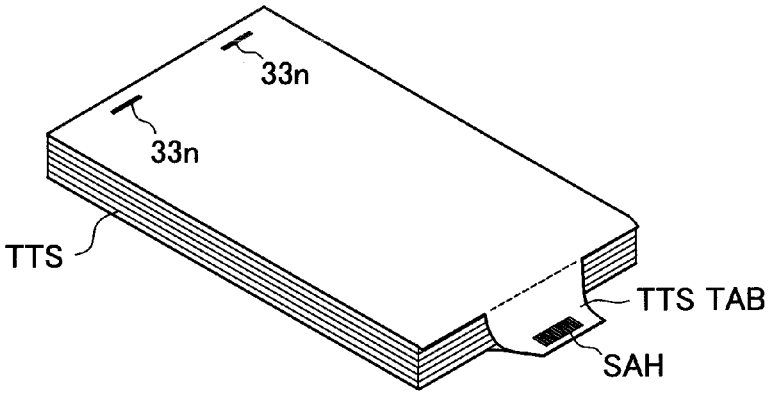
Figure 14:
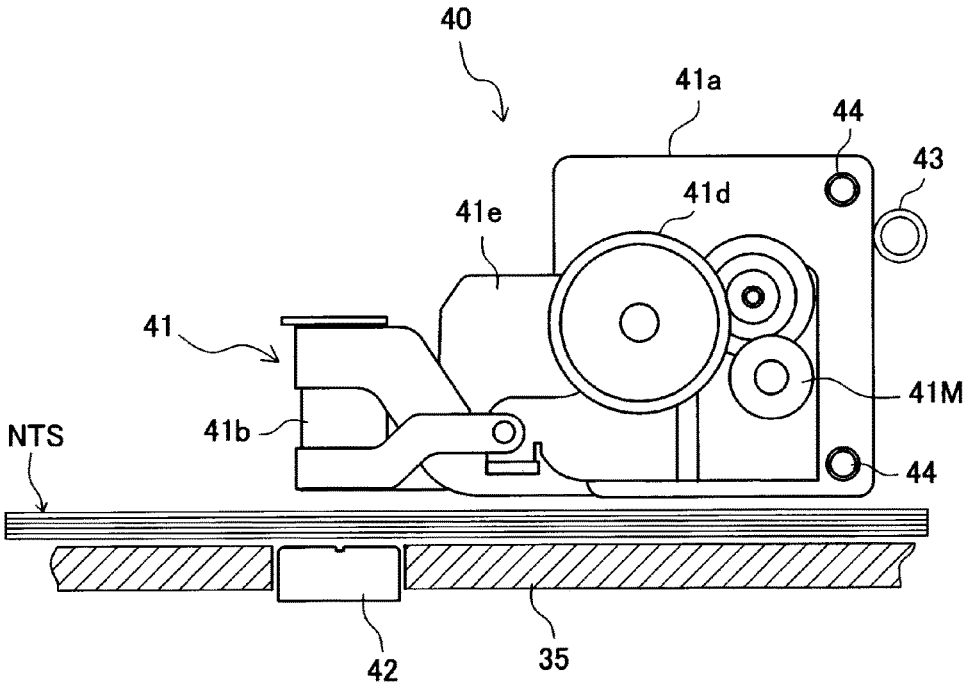
FIG. 14 is an explanatory view of a saddle-stitching stapler unit of the sheet processing device illustrated in FIG. 2.

FIG. 11B is a sheet pattern in which one tab-shaped protruding portion TTS-TAB is formed at the leading end side of the end surface bound sheet bundle TTS. In this case, a booklet of an end surface bound sheet bundle TTS with tab illustrated in FIG. 13B is obtained. Since the protruding portion TTS-TAB is comparatively small, the tab portion can easily be cut or torn when the document is actually used.

In this way, the end surface bound sheet bundle TTS with ensured security can be obtained.

[Configuration of Saddle-Stitching Section]

The following describes saddle-stitching to be performed on the far side of the second conveying path P2 extending vertically from the first conveying path P1 in FIG. 2 and a security ensuring method for the saddle-stitched sheet bundle. Specifically, with reference to FIG. 14 to FIGS. 18A to 18D, the saddle-stitching section that produces the saddle-stitched sheet bundle NTS and folded sheet bundle pressure-bonding binding unit 70 that applies the pressure-bonding binding to the protruding portion at the leading end side of the saddle-stitched sheet bundle NTS will be described. Hereinafter, including the saddle-stitching section and folded sheet bundle pressure-bonding binding unit 70, a stacker 35, a saddle-stitching stapler unit 40, and a folding mechanism (folding roller 45 and folding blade 46) will be sequentially described.

[Stacker]

The stacker 35 is configured to vertically stack and accommodate in a standing posture the sheets sequentially carried in to the downstream side of the second conveying path P2 from the carry-in port 23. The stacker 35 illustrated in FIG. 2 is disposed substantially vertically so as to go across the device frame 20 and accommodate the sheets in a standing position, thereby reducing the device size. Further, the stacker 35 is formed into a length shape that accommodates therein the maximum size sheet. The stacker 35 has a shape suitable for arranging the saddle-stitching stapler unit 40, folding mechanism (folding roller pair 45 and folding blade 46), and folded sheet bundle pressure-bonding binding unit 70 which will be described later. The stacker 35 is provided with a stopper 38 serving as a leading end regulating member that regulates a sheet leading end. Upon carry-in of the sheet into the stacker 35, depending on the sheet size (length of the sheet in the discharge direction), the stopper 38 is moved to a position suitable for the binding operation of the saddle-stitching stapler unit 40 or folding operation of the folding roller pair 45 and folding blade 46.

That is, a highest position Sh3 of FIG. 2 is a position at which the stopper 38 receives the sheet from a conveying roller 36 disposed in the second conveying path P2. A position Sh2 is a position at which the saddle-stitching stapler unit 40 binds the sheet bundle at a center portion thereof in the sheet conveying direction using a saddle-stitching staple needle 41*n*. Further, the position Sh3 is a position at which the sheet bundle is pushed to the folding roller pair 45 side by the folding blade 46 and then folded in two by the folding roller pair 45. This position Sh3 is set as a position at which the binding position of the sheet bundle by the saddle-stitching stapler unit 40 is folded. As illustrated in FIG. 2, side upper aligning plates 39*a* (near side and far side in the drawing) and side lower aligning plates 39*b* (near side and far side in the drawing) that align the sheet carried in onto the stacker 35 are disposed on upper and lower sides of the folding position, respectively.

[Saddle-Stitching Stapler Unit]

The saddle-stitching stapler unit 40 that performs saddle-stitching using the saddle-stitching staple needle 41*n* is disposed in the stacker 35 and staple-binds the sheet bundle aligned and accumulated in the stacker 35 at a center portion thereof. A configuration of the saddle-stitching stapler unit 40 will be described based on FIG. 14. The saddle-stitching stapler unit 40 is constituted of a staple unit 41 and a clincher 42. The staple unit 41 includes a staple head 41*b* that pierces the saddle-stitching staple needle 41*n* into the sheet bundle set at the binding position, a cartridge 41*e* that accommodates therein the saddle-stitching staple needles 41*n*, a drive cam 41*d*, and a saddle-stitching stapler motor 41M that drives the drive cam 41*d*. Although not particularly illustrated, the saddle-stitching staple needle 41*n* having a linear shape is bent into a U-like shape, and the bent staple needle 41*n* is driven into the sheet bundle by the staple head 41*b*.

The clincher 42 is disposed at a position facing the above-described staple unit 41 across the sheet bundle. The illustrated clincher 42 is constituted of a structure separated from the staple unit 41 and bends the needle point of the saddle-stitching staple needle 41*n* pierced into the sheet bundle by the staple head 41*b*. To this end, the clincher 42 has a bending groove for bending the leading end of the saddle-stitching staple needle 41*n*. Although not particularly illustrated, the clincher 42 has two or more bending grooves which are arranged in the width direction of the sheet bundle accumulated in the stacker 35, and the staple unit 41 movable to the bending grooves 250*a* staple-binds the sheet bundle at the plurality of locations in the sheet width direction. Thus, it is possible to staple the sheet bundle supported on the stacker 35 at two locations in the sheet width direction without the need of moving the clincher 42.

[Folding Mechanism]

Figure 15A:
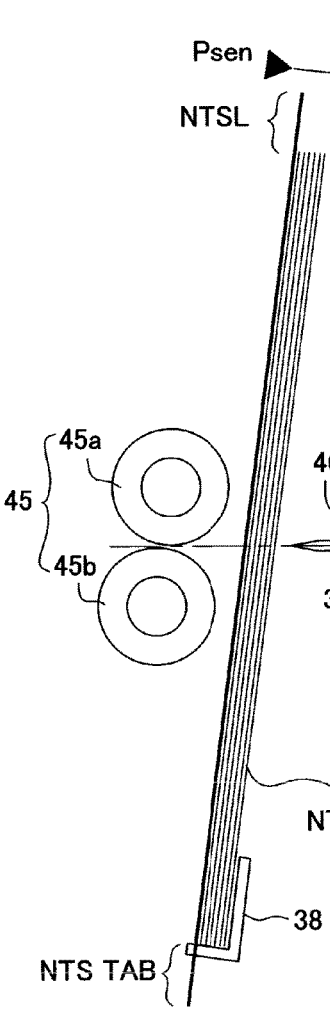
Figure 15B:
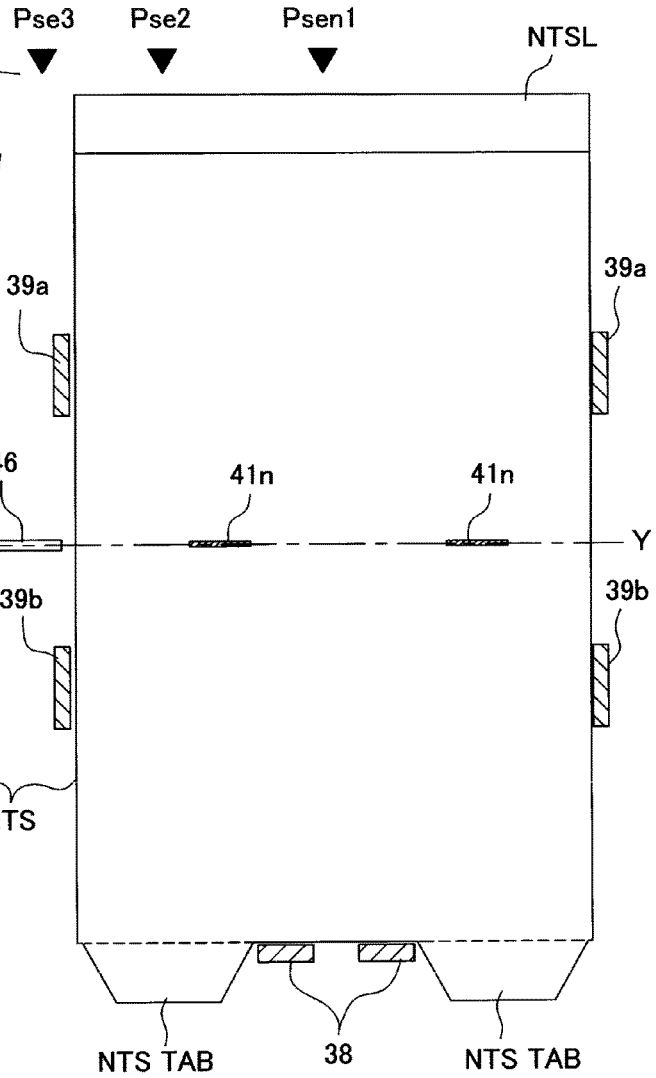

As illustrated in FIG. 2, at the folding position set downstream of the above-described saddle-stitching stapler unit 40, a folding roller pair 45 that folds the sheet bundle and a folding blade 46 that inserts the sheet bundle into a nip position of the folding roller pair 45 are disposed. The two types of long and short sheets accumulated in a mixed state in the stacker 35 are subject to folding with the binding position as a folding position Y. In the example of FIGS. 15A and 15B, a saddle-stitched sheet bundle protruding portion NTSL of a folding roller 45 side sheet protrudes upward in the drawing, and a saddle-stitching sheet tab NTS-TAB of the same sheet protrudes downward at a side of the stopper 38. When the long sheet and short sheets as interleaves are pushed into the folding roller pair 45 by the folding blade 46, the saddle-stitched sheet bundle protruding portion NTSL and saddle-stitching sheet tab NTS-TAB overlap each other.

Figure 16A:
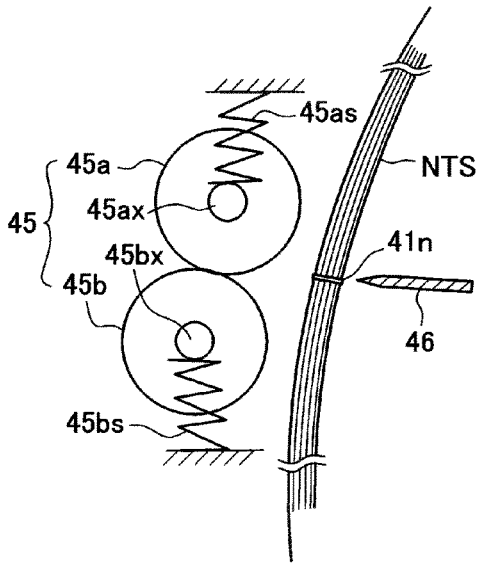

For example, as illustrated in FIG. 16A, the folding roller 45 is constituted of rollers 45*a* and 45*b* which are brought into pressure contact with each other, and each of the rollers 45*a* and 45*b* have a length corresponding to the substantially maximum width of the sheet. Rotary shafts 45*ax* and 45*bx* of the respective rollers 45*a* and 45*b* constituting the folding roller 45 are fitted to long grooves of an unillustrated device frame 20 and are biased in a pressure-contact direction by respective compression springs 45*a*S and 45*b*S so as to bring the rollers 45*a* and 45*b* into pressure contact with each other. The folding roller 45 may have a structure in which at least one of the rollers 45*a* and 45*b* is axially supported so as to be movable in the pressure-contact direction and is provided with the compression spring.

The pair of rollers 45*a* and 45*b* are each formed of a material, such as a rubber, having a comparatively large friction coefficient. This is for conveying the sheet bundle in a roller rotation direction while folding the same by a soft material such as a rubber, and the rollers 45*a* and 45*b* may be formed by applying lining to a rubber material.

[Operation of Folding Mechanism]

Hereinafter, an operation of the folding mechanism that moves the saddle-stitched sheet bundle NTS bound by the saddle-stitching staple needle 41*n* to the folding position Sh2 and applies folding at this position will be described.

With reference to FIGS. 16A to 16D, an operation of folding the sheet bundle by the folding roller 45 will be described. The pair of folding rollers 45*a* and 45*b* are positioned below the saddle-stitching stapler unit 40 disposed in the stacker 35, and the folding blade 46 is disposed at a position facing the pair of folding rollers 45*a* and 45*b* across the bonded sheet bundle supported on the stacker 35. The folding blade 46 is supported by the device frame so as to be reciprocatable between a home position illustrated in FIG. 16A and an activation position illustrated in FIG. 16C.

The saddle-stitched sheet bundle NTS supported in a bundle on the stacker 35 is locked by the stopper 38 at the leading end of the stacker 35 as illustrated in FIG. 16A, and the folding position thereof is positioned as the binding position thereof bound by the saddle-stitching staple needle 41*n*.

Figure 16B:
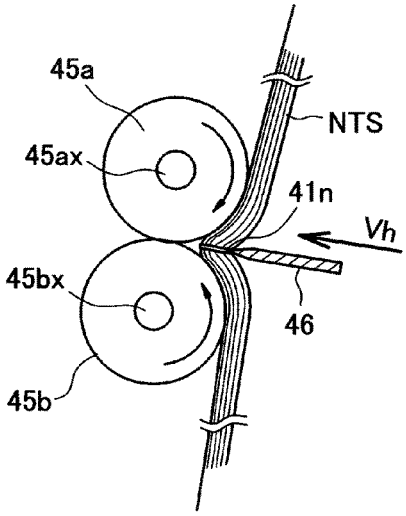
Figure 16C:
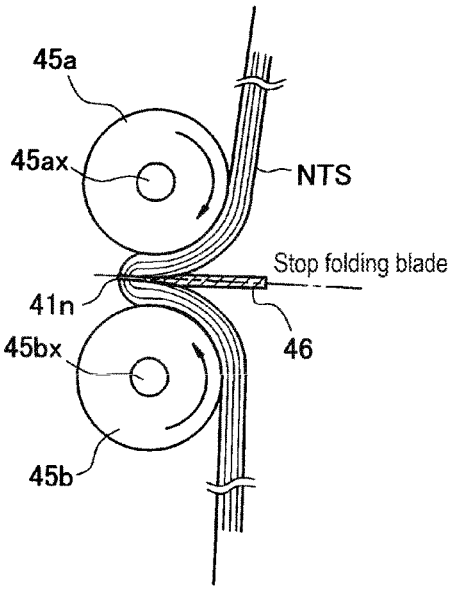
Figure 16D:
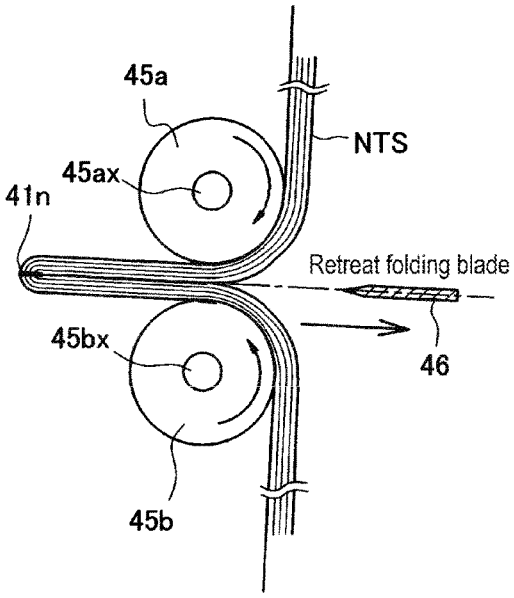

A saddle-stitching/center-folding controller 113 moves the folding blade 46 from the standby position to nip position. Then, as illustrated in FIG. 16B, the sheet bundle is bent by the folding blade 46 at the folding position and is inserted between the rollers 45*a* and 45*b*. At this time, the pair of rollers 45*a* and 45*b* are driven into rotation along with the movement of the saddle-stitched sheet bundle NTS by the folding blade 46. Then, the saddle-stitching/center-folding controller 113 reversely rotates a folding drive motor 45M after elapse of an estimated time period during which the saddle-stitched sheet bundle NTS reaches a predetermined nip position to stop the folding blade 46 at a position illustrated in FIG. 16C. On the other hand, the folding roller 45 continues rotating in the folding direction. As a result, the saddle-stitched sheet bundle NTS is fed in a delivery direction (left side in the drawing). Thereafter, the saddle-stitching/center-folding controller 113 normally rotates the folding drive motor 45M again. As a result, as illustrated in FIG. 16D, the folding blade 46 positioned at the nip position is moved to the standby position concurrently with the delivery of the sheet bundle by the folding roller 45.

[Configuration of Folded Sheet Bundle Pressure-Bonding Binding Unit]

The following describes the folded sheet bundle pressure-bonding binding unit 70 that applies pressure-bonding binding to the protruding portion protruding from the interleaves of the saddle-stitched sheet bundle NTS folded by the folding mechanism.

Figure 17:
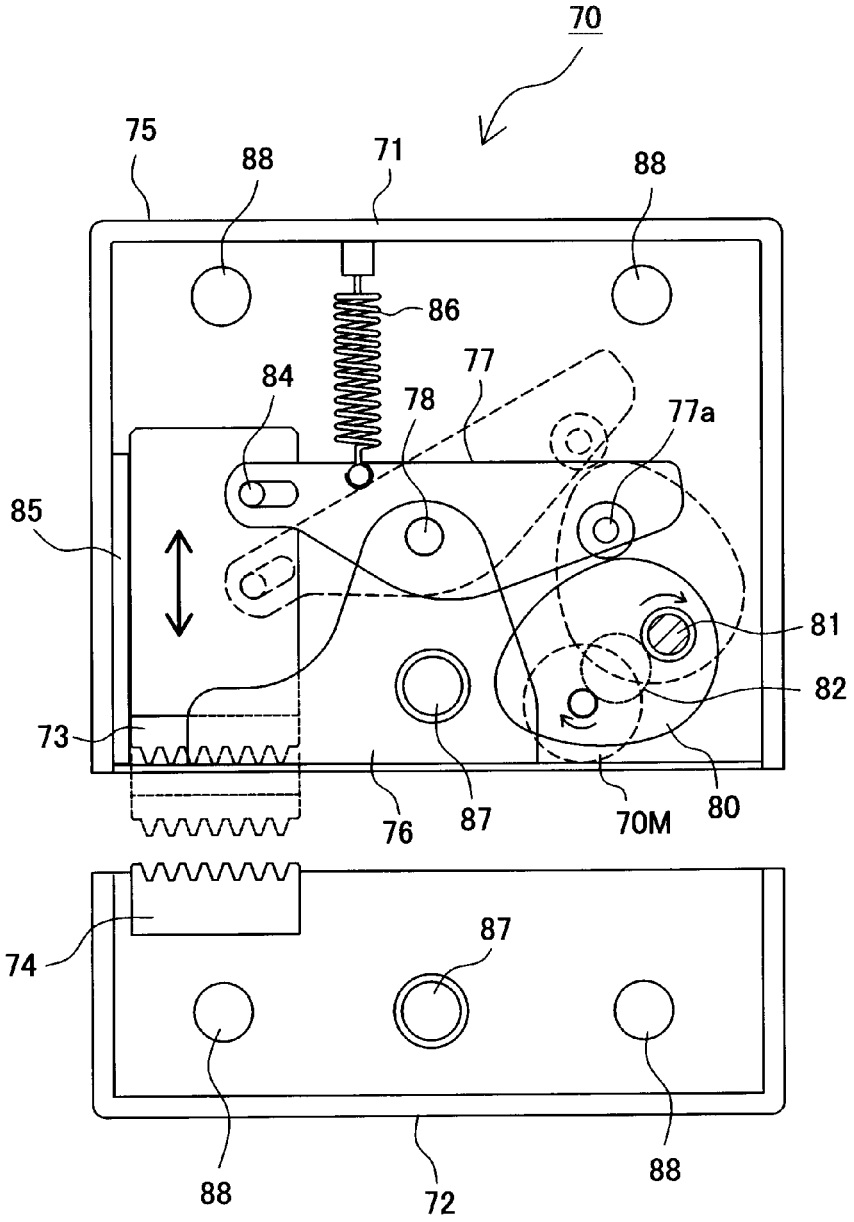
FIG. 17 illustrates a folded sheet bundle pressure-bonding binding unit of FIG. 2 that binds a fore edge side of a saddle-stitched and folded sheet bundle.

The folded sheet bundle pressure-bonding binding unit 70 is disposed in a bundle discharge path extending from the folding roller 45 to the bundle discharge roller 95. As illustrated in FIG. 17, the folded sheet bundle pressure-bonding binding unit 70 includes a pressure-bonding upper unit 71 and a pressure-bonding lower unit 72. The pressure-bonding upper unit 71 vertically movably supports an upper pressure-bonding tooth part 73. The pressure-bonding lower unit 72 supports a lower pressure-bonding tooth part 74 disposed opposite to the upper pressure-bonding tooth part 73.

In the pressure-bonding upper unit 71, the upper pressure-bonding tooth part 73 is supported on a slide guide surface 85 provided on a left surface of the unit so as to be vertically movable. At the bottom of the pressure-bonding upper unit 71, a moving lever 77 that turns with a support portion 78 at the top of a base plate 76 fixedly mounted as a fulcrum is provided. A leading end side of the moving lever 77 is mounted to a mounting portion 84 of the upper pressure-bonding tooth part 73. Further, a rear end side of the moving lever 77 is mounted with a cam receiver 77*a*. A pressure-bonding binding motor 70M mounted to the bottom of the pressure-bonding upper unit 71 is provided for the cam receiver 77*a*. A driving force of the pressure-bonding binding motor 70M is transmitted, through a tooth connecting gear 82, to an eccentrically rotated pressure-bonding cam 80.

Thus, driving the pressure-bonding binding motor 70M rotates the pressure-bonding cam 80, causing the cam receiver 77*a* of the moving lever 77 to be moved. A spring 86 is provided at a leading end side of the moving lever 77. The spring 86 always biases the cam receiver 77*a* against the pressure-bonding cam 80.

Further, at an upper portion of the pressure-bonding upper unit 71, two guide rods 88 are provided in the front and rear in the sheet conveying direction so that the pressure-bonding upper unit 71 can be moved therealong in the sheet width direction. A lead screw 87 that moves the base plate 76 is threadedly mounted between the guide rods 88. Rotating the lead screw 87 moves the pressure-bonding upper unit 71 in the width direction of the folded sheet bundle.

On the other hand, the lower pressure-bonding tooth part 74 is disposed opposite to the upper pressure-bonding tooth part 73. The lower pressure-bonding tooth part 74 is supported by the pressure-bonding lower unit 72. The pressure-bonding lower unit 72 is also movably supported by the guide rods 88 provided in the front and rear in the sheet conveying direction, and a lead screw 87 is threadedly mounted therebetween. The lead screw 87 is rotated synchronously with the lead screw 87 of the pressure-bonding upper unit 71. Accordingly, when the lead screw 87 is rotated, the pressure-bonding upper unit 71 and pressure-bonding lower unit 72 are integrally moved in the width direction of the folded sheet bundle in synchronism with each other.

In the above embodiment, the pressure-bonding upper unit 71 and pressure-bonding lower unit 72 are moved in the sheet width direction; however, a configuration may be adopted, in which only the pressure-bonding upper unit 71 is moved in the sheet width direction, and the pressure-bonding lower unit 72 is fixedly provided at a plurality of specified locations. Alternatively, both the pressure-bonding upper unit 71 and pressure-bonding lower unit 72 may be fixedly provided at a plurality of locations in the sheet width direction.

[Configuration of Pressure-Bonding Tooth Part]

Hereinafter, a brief description will be given of the upper pressure-bonding tooth part 73 and lower pressure-bonding tooth part 74 that pressure-bond the folded sheet bundle from front and back sides thereof. The upper and lower pressure-bonding tooth parts 73 and 74 have the same configuration as that of the end surface upper and lower pressure-bonding tooth parts 53 and 54 of the end surface pressure-bonding binding unit 50 and press the sheet bundle with a comparatively large force [about 500 kg to 700 kg] from front and back sides thereof. A part of the upper pressure-bonding tooth part 73 or lower pressure-bonding tooth part 74 that pressure-bonds the sheet bundle has projections and recesses with parallel edge lines. Thus, when the pressure-bonding binding motor 70M is driven to make the upper pressure-bonding tooth part 73 and lower pressure-bonding tooth part 74 mesh with each other with the sheet protruding portion interposed therebetween, fibers of the sheets are entangled to thereby achieve binding of the sheet bundle. This binding force is smaller than that of the staple needle 41*n*, and thus, this process is called "temporary binding" with respect to "proper binding" as in the case of the end surface pressure-bonding binding performed by the end surface pressure-bonding binding unit 50.

[Configuration of Bundle Conveying Member]

A bundle pressing roller 90 is disposed downstream of the above-described folded sheet bundle pressure-bonding binding unit 70, and a bundle discharge roller 95 is disposed downstream of the bundle pressing roller 90. The bundle pressing roller 90 conveys the two-folded saddle-stitched sheet bundle NTS, and the bundle discharge roller 95 discharges the two-folded saddle-stitched sheet bundle NTS onto the second discharge tray 22. Although not illustrated, shafts of the bundle pressing roller pair 90 are brought close to each other by a cam or the like so that the bundle pressing roller 90 presses (applies pressure in an arrow R5 direction so as to enhance mutual pressure contact force) the saddle-stitched sheet bundle NTS more forcefully than usual from front and back sides thereof. Although described later, enhancement of the pressure contact force of the bundle pressing roller 90 prevents the saddle-stitched sheet bundle NTS from being displaced when the protruding portions are pressure-bonded by the folded sheet bundle pressure-bonding binding unit 70.

[Operation of Folded Sheet Pressure-Bonding Binding]

The following describes, with reference to FIGS. 18A to 18D, an operation of pressure-bonding binding the protruding portions (NTSL and NTS-TAB, or NTS-TAB and NTS-TAB) of the folded saddle-stitched sheet bundle NTS.

Figure 18A:
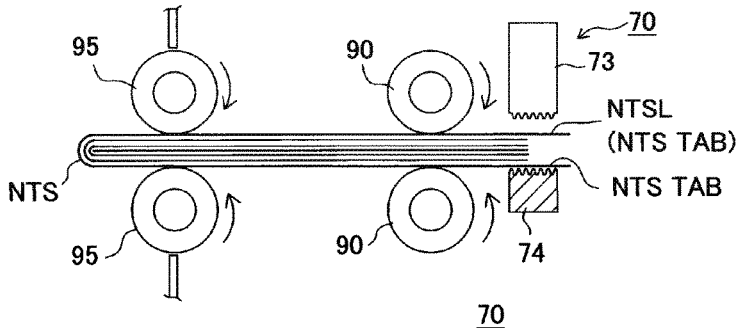

FIG. 18A is a view illustrating a state where the saddle-stitched sheet bundle NTS is conveyed along the bundle conveying path TP to move a fore edge thereof to a position corresponding to the folded sheet bundle pressure-bonding binding unit 70. More specifically, in FIG. 18A, the saddle-stitched sheet bundle NTS folded in two by the folding roller 45 and folding blade 46 of FIGS. 16A to 16D is nipped and conveyed by the bundle pressing roller pair 90 positioned downstream of the folded sheet bundle pressure-bonding binding unit 70 and the bundle discharge roller pair 95 positioned downstream of the bundle pressing roller pair 90. Then, when at least two fore edge side protruding portions (NTSL and NTS-TAB) of the saddle-stitched sheet bundle NTS reach a position corresponding to the upper and lower pressure-bonding tooth parts 73 and 74 of the folded sheet bundle pressure-bonding binding unit 70, conveyance of the saddle-stitched sheet bundle NTS by the bundle pressing roller 90 and bundle discharge roller 95 is stopped.

Figure 18B:
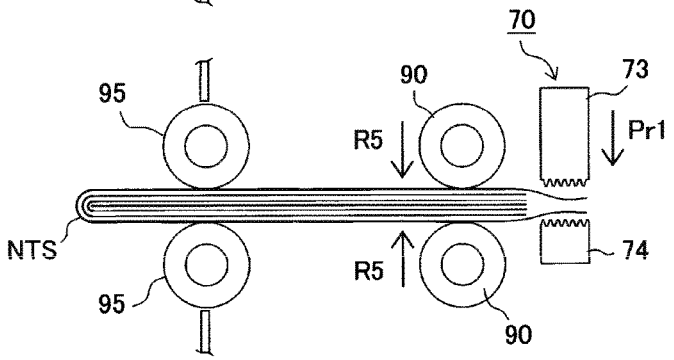

FIG. 18B is a view illustrating a state where the folded sheet bundle pressure-bonding binding unit 70 starts the pressure-bonding binding. At this stage, the upper and lower pressure-bonding tooth parts 73 and 74 come close (arrow PR1 direction) to a position at which they mesh with each other at a predetermined pressure. Prior to the above operation, the bundle pressing roller 90 presses (applies pressure in the arrow R5 direction so as to enhance mutual pressure contact force) the saddle-stitched sheet bundle NTS more forcefully than usual from front and back sides thereof. As a result, the saddle-stitched sheet bundle NTS is gripped from the front and back sides thereof.

Figure 18C:
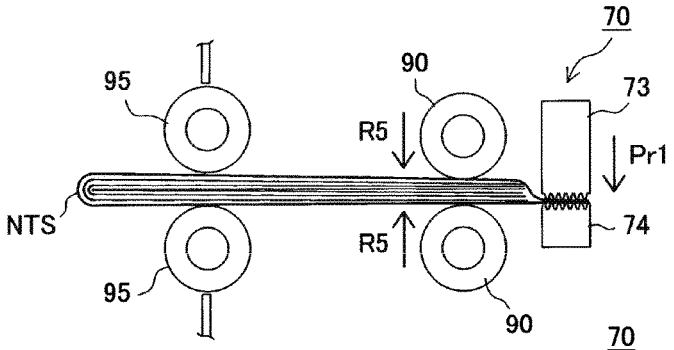

FIG. 18C is a view illustrating a state where the folded sheet bundle pressure-bonding binding unit 70 is performing the pressure-bonding binding. After the gripping of the saddle-stitched sheet bundle NTS by the bundle pressing roller 90, the upper and lower pressure-bonding tooth parts 73 and 74 mesh with each other (arrow PR1 direction) to cause the fibers of the sheets to be deformed and entangled to thereby achieve the pressure-bonding binding. At this time, the bundle pressing roller 90 holds the saddle-stitched sheet bundle NTS with a comparatively large force. This is for preventing occurrence of a bundle displacement. That is, since only the two sheet protruding portions (NTSL and NTS-TAB, or NTS-TAB and NTS-TAB) protrude from the fore edge side of the saddle-stitched sheet bundle NTS, the upper and lower pressure-bonding tooth parts 73 and 74 catch the sheets in the course of meshing, which may result in the bundle displacement.

Figure 18D:
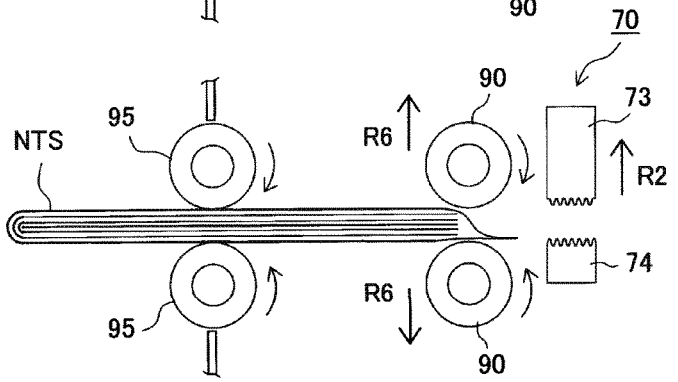

FIG. 18D is a view illustrating a state where the folded saddle-stitched sheet bundle NTS is discharged after completion of the pressure-bonding binding by the folded sheet bundle pressure-bonding binding unit 70. After completion of the pressure-bonding binding, meshing between the upper and lower pressure-bonding tooth parts 73 and 74 is released and moved in a mutually separating direction (arrow R2 direction). At the same time, the pressure contact force of the bundle pressing roller 90 is reduced (arrow R6 direction). At this stage, the bundle pressing roller 90 and bundle discharge roller 95 are rotated in the discharge direction to discharge the saddle-stitched sheet bundle NTS whose fore-edge side has been subjected to the pressure-bonding binding to the second discharge tray 22.

In the manner as described above, the proper binding by the saddle-stitching staple needle 41*n* of the saddle-stitching stapler unit 40 and the temporary binding by the pressure-bonding binding of the folded sheet bundle pressure-bonding binding unit 70 are performed, whereby a saddle-stitched booklet with ensured security can be provided.

Some sheet patterns of the saddle-stitched sheet bundle NTS having the protruding portion to which the above proper and temporary binding can be applied will be described with reference to FIGS. 19A to 19C and FIGS. 20A and 20B. FIGS. 21A to 21C and FIGS. 22A and 22B are perspective views illustrating saddle-stitched booklets as products obtained by applying the proper and temporary binding to the respective sheet patterns.

[Sheet Pattern for Saddle-Stitching Having Protruding Portion]

FIGS. 19A to 19C and FIGS. 20A and 20B illustrate different types of sheet patterns. More specifically, FIGS. 19A to 19C and FIGS. 20A and 20B each illustrate a pattern of the protruding portion of the sheet constituting the saddle-stitched sheet bundle NTS bound by the saddle-stitching staple needle 41*n* and placed on the processing tray 29. In the drawings, the interleaves are placed on the sheet with protruding portion.

Figure 19A:
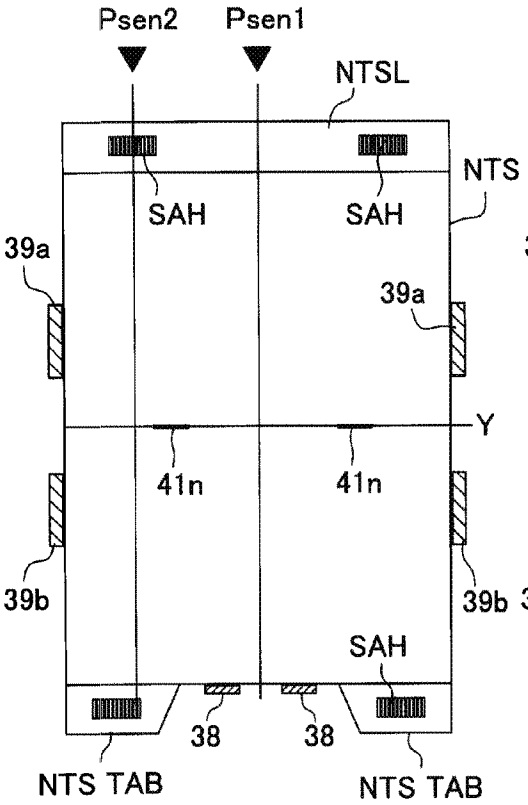

FIG. 19A is a sheet pattern of a sheet whose stopper 38 side has saddle-stitching sheet tab portions NTS-TAB on the outside thereof in the sheet width direction and whose side opposite to the saddle-stitching sheet tab portions NTS-TAB has a saddle-stitching protruding portion. FIG. 19A illustrates a state before the saddle-stitched sheet bundle NTS aligned by the side upper aligning plates 39*a* and side lower aligning plates 39*b* is folded by the folding blade 46. Positions to be bound by the folded sheet bundle pressure-bonding binding unit 70 after the folding of the saddle-stitched sheet bundle NTS are indicated by "pressure-bonding binding SAH".

Figure 21A:
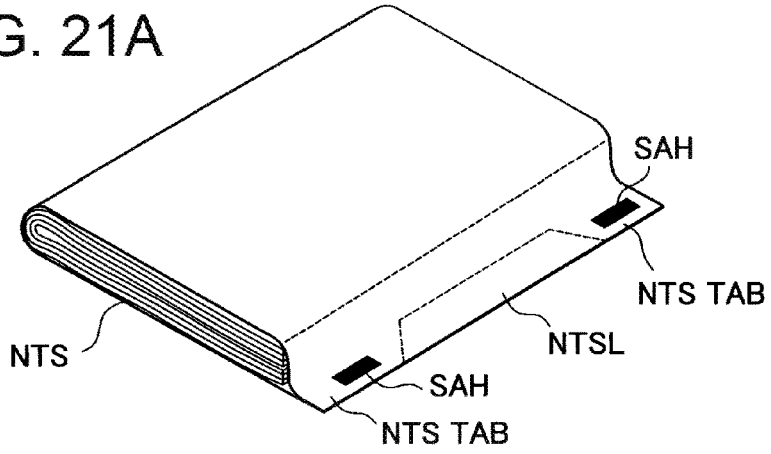
FIGS. 21A to 21C are perspective views of temporarily-bound sheet bundles having the patterns of FIGS. 19A to 19C, in which FIGS. 21A, 21B, and 21C correspond to FIGS. 19A, 19B, and 19C, respectively.

In this case, a booklet of a saddle-stitched sheet bundle NTS illustrated in FIG. 21A in which both ends of the fore edge side of the saddle-stitched sheet bundle NTS are temporarily bound to cover the interleaves is obtained.

The sensors Psen1 to Psen3 provided at an exit of the second conveying path are disposed spaced apart from one another in the sheet width direction and detect the length of the sheet passing therethrough. Thus, whether the sheet carried in onto the stacker 35 is a short sheet or a sheet having the saddle-stitched sheet bundle protruding portion NTSL or saddle-stitching sheet bundle tab portions NTS-TAB can be detected.

Figure 19B:
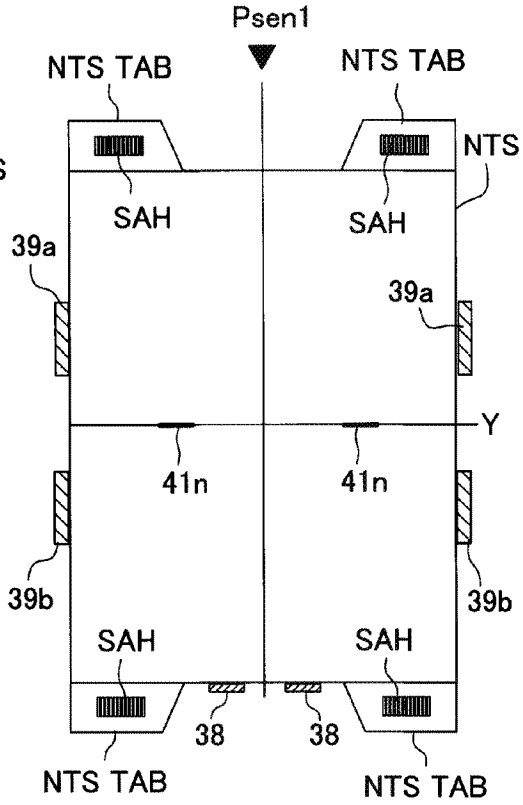
Figure 21B:
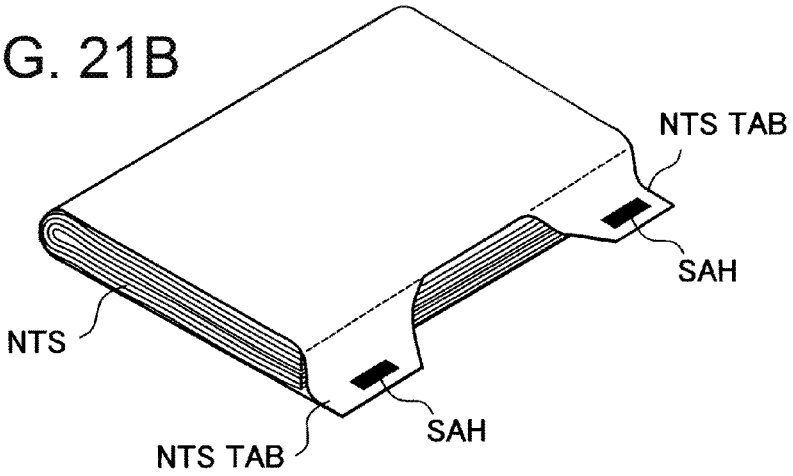

FIG. 19B is a sheet pattern of a sheet whose both the stopper 38 side and its opposite side have two saddle-stitching sheet tab portions NTS-TAB on the outside thereof in the sheet width direction. In this case, the pressure-bonding binding SAH is applied to these tab portions, whereby a booklet of a saddle-stitched sheet bundle NTS with tab illustrated in FIG. 21B is obtained.

Figure 19C:
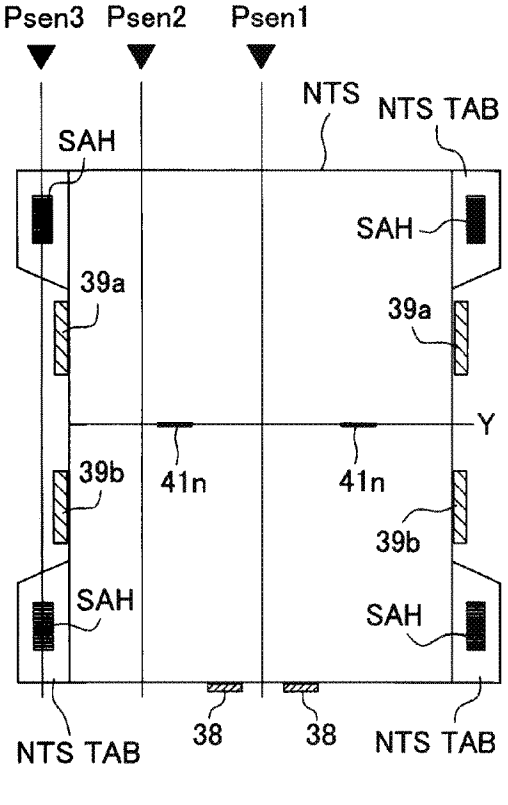
Figure 21C:
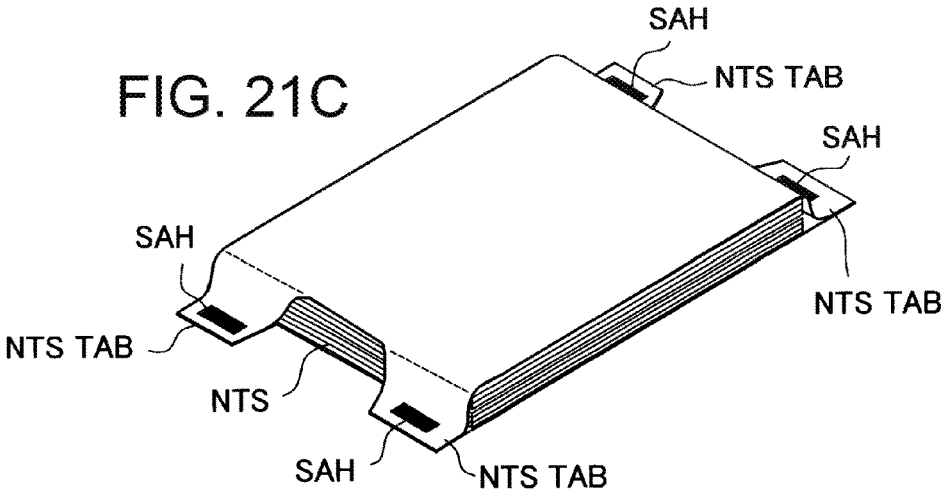

FIG. 19C is a sheet pattern in which two tab-shaped protruding portions (NTS-TAB) protruding in the sheet width direction are formed. As a result, the saddle-stitched sheet bundle NTS of FIG. 19C has a protruding portion of a comparatively wide range. The pressure-bonding binding SAH is applied to the tab portions and, in this case, a booklet of a saddle-stitched sheet bundle NTS with tab illustrated in FIG. 21C is obtained.

The tab is not formed at a part of the saddle-stitched sheet bundle NTS that is pressed by the side upper aligning plates 39*a* and side lower aligning plates 39*b* so that both the long and short sheets can be aligned.

Figure 20B:
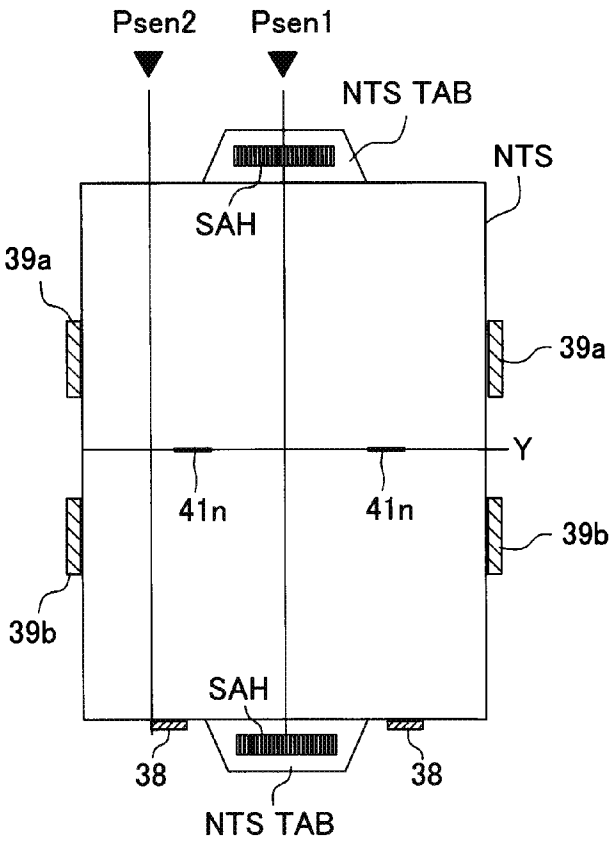
Figure 20A:
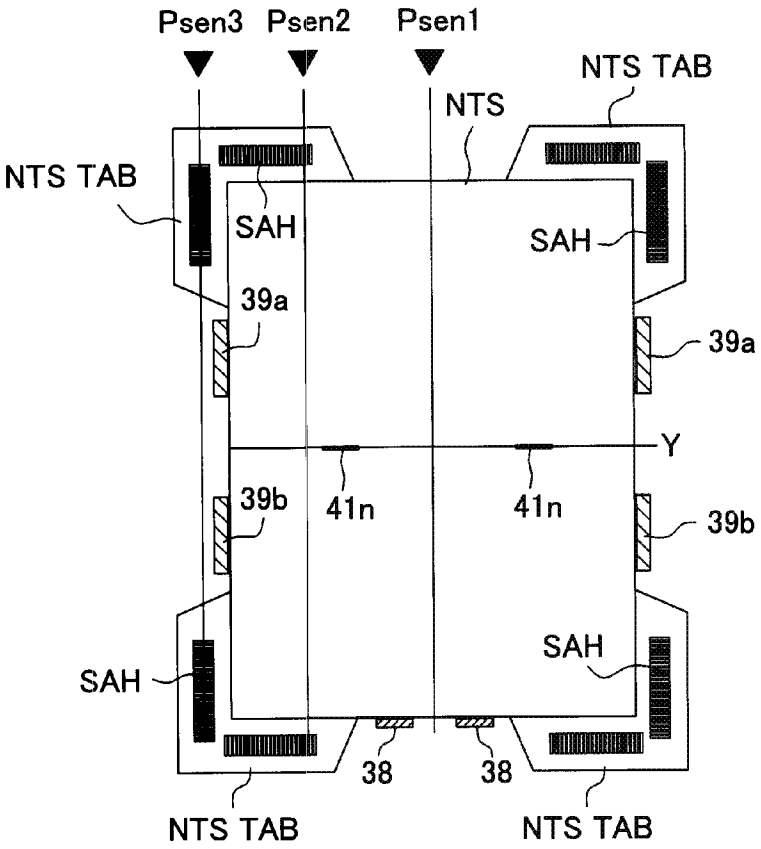
Figure 22A:
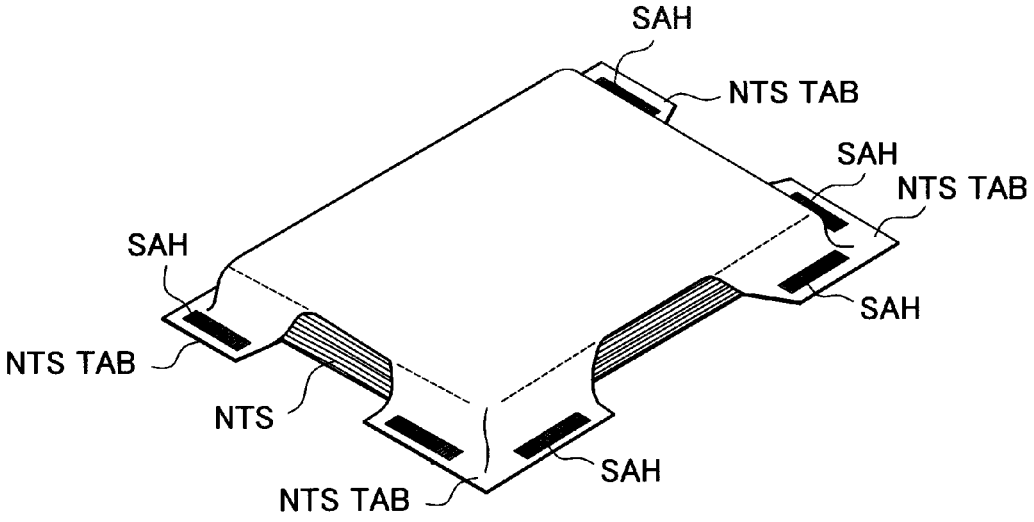
FIGS. 22A and 22B are perspective views of temporarily-bound sheet bundles having the patterns of FIGS. 20A and 20B, in which FIGS. 22A and 22B correspond to FIGS. 20A and 20B, respectively.

FIG. 20A is a sheet pattern in which two tab-shaped protruding portions (NTS-TAB) each protruding both in the upward direction and in the width direction are formed on both the stopper 38 side and its opposite side. As a result, the saddle-stitched sheet bundle NTS of FIG. 20A has a protruding portion of a comparatively wide range. The pressure-bonding binding SAH is applied to the tab portions and, in this case, a booklet of a saddle-stitched sheet bundle NTS with tab illustrated in FIG. 22A is obtained.

Figure 22B:
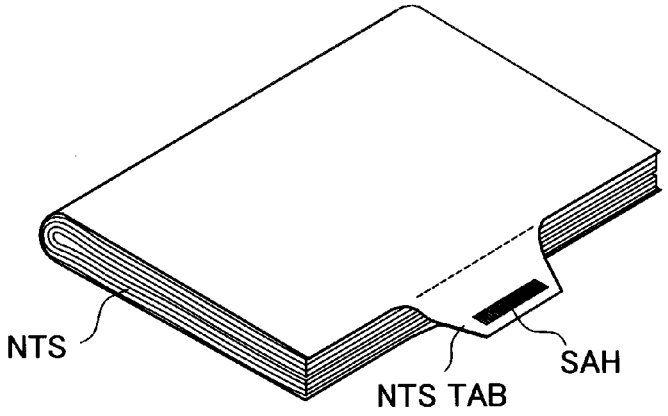

FIG. 20B is a sheet pattern in which one saddle-stitching sheet tab portion NTS-TAB is formed on the stopper 38 side and its opposite side. In this case, a booklet of a saddle-stitched sheet bundle NTS with tab illustrated in FIG. 22B is obtained. Since the saddle-stitching sheet tab portion NTS-TAB as the protruding portion is comparatively small, the tab portion can easily be cut or torn when the document is actually used.

In this way, the saddle-stitched sheet bundle NTS with ensured security can be obtained.

Figure 23A:
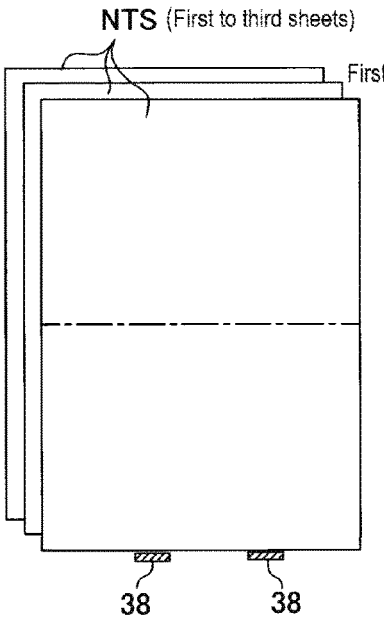
Figure 23B:
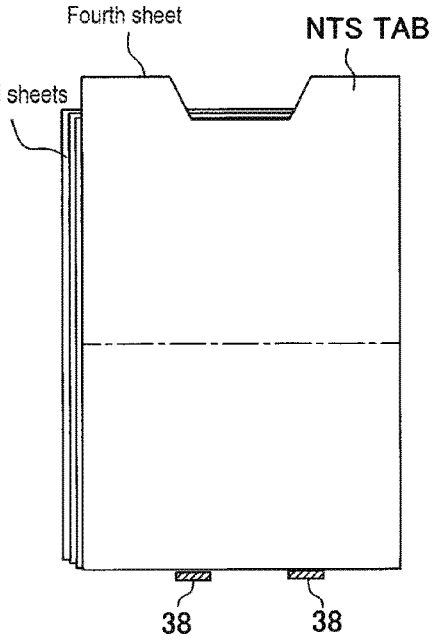
Figure 23C:
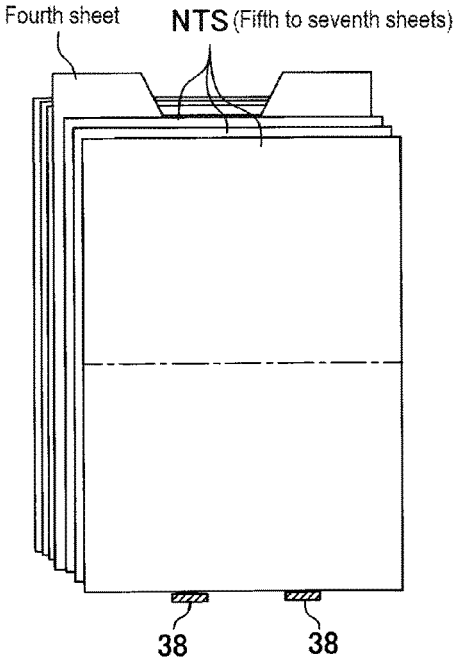
Figure 23D:
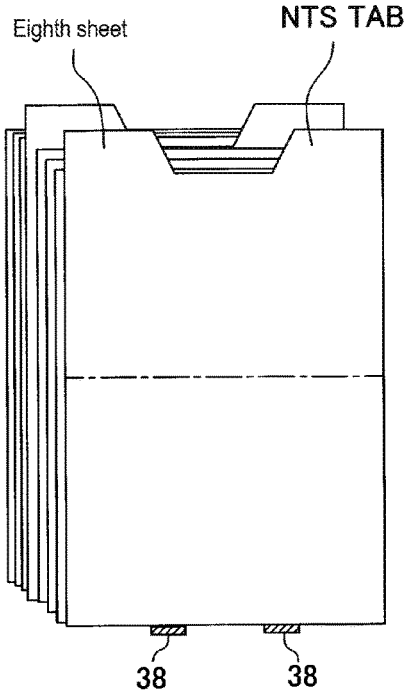

The protruding portions of the saddle-stitched sheet bundle NTS in FIGS. 19A to 19C to FIGS. 22A and 22B are formed in a sheet positioned closest to the folding roller side. Alternatively, however, the following configuration may be adopted. That is, a plurality of sheets each having a tab only on a leading end side (the side opposite to the stopper 38 side) are inserted between the interleaves with the length of all the sheets to be saddle-stitched accumulated in the stacker 35 side being the same. For example, short sheets as the interleaves are used as the first to third sheets to be carried in onto the stacker 35 (FIG. 23A), and a sheet with tab in which the leading end side opposite to the stopper 38 side protrudes is used as the fourth sheet (FIG. 23B). Then, short sheets are used as the fifth to seventh sheets (FIG. 23C) and, finally, the same sheet with tab as the fourth sheet is used as the eighth sheet positioned closest to the folding roller 45 (FIG. 23D).

Figure 24A:
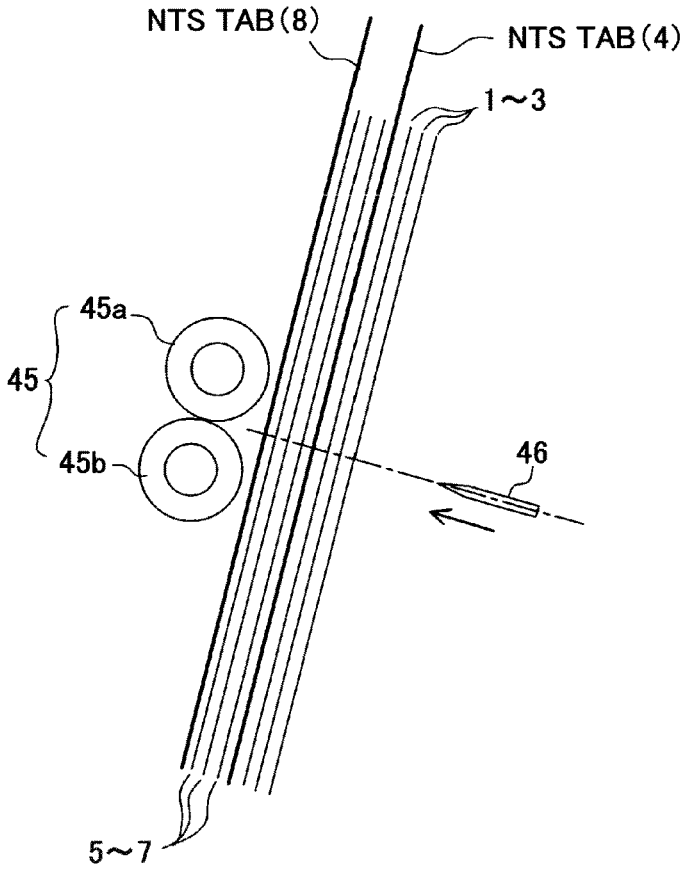
Figure 24B:
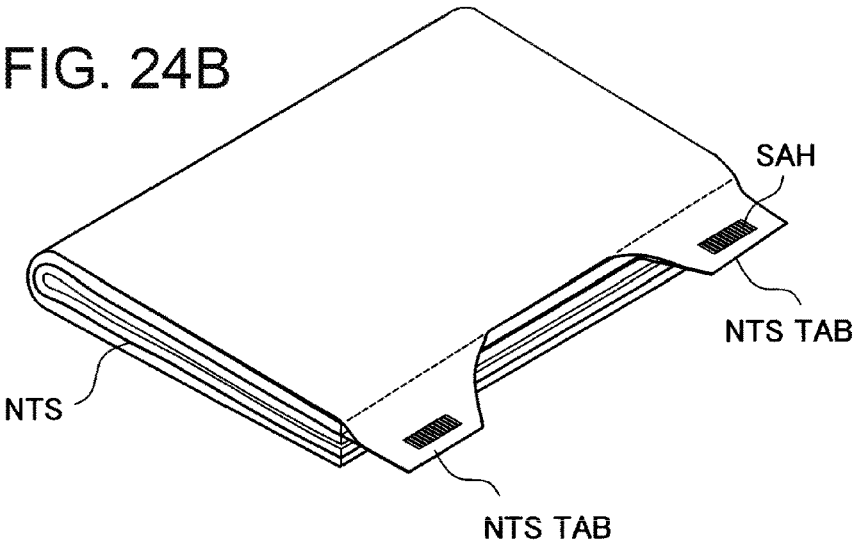

FIG. 24A is a cross-sectional view illustrating a state where the above eight sheets are accumulated, in which the fourth and eighth sheets have the sheet tab portions NTS-TAB, respectively, on the leading end side. This sheet bundle is folded using the folding roller 45 and folding blade 46, and then the tab portions are bound by the folded sheet bundle pressure-bonding binding unit 70 positioned downstream of the folding roller 45 and folding blade 46. As a result, as illustrated in FIG. 24B, temporary binding is partially achieved, i.e., security can be partially ensured.

[Check of Sheet Length in Security Binding Mode]

As described above several times, as illustrated in FIG. 2, the sheet processing controller 106 of the present invention detects presence of the sheet with tab as follows. That is, in the case of the end surface binding, the sheet processing controller 106 detects a sheet length using the sensors S1 to S3 disposed in the first conveying path P1 at a position upstream of the punch unit 28 in the sheet conveying direction in the case of the end surface binding; while, in the case of saddle-stitching, the sheet processing controller 106 detects the sheet length using the sensors disposed near the exit of the second conveying path P2. In the present invention, the sheet with tab (protruding portion) is placed on the sheet placing table 1*c* illustrated in FIG. 1 and supplied therefrom. In this case, if the placed sheet is not long or has no tab, the temporary binding cannot be performed even when the security binding mode is executed, resulting in a failure of ensuring security. To avoid this, the device of the present embodiment performs checking according to a flowchart illustrated in FIG. 25. The following checking method can be applied equally to both the end surface binding and saddle-stitching, so that in the following description, "security binding mode" of the end surface binding and "security saddle-stitching mode" of the saddle-stitching are collectively referred to as "security binding mode".

Figure 25:
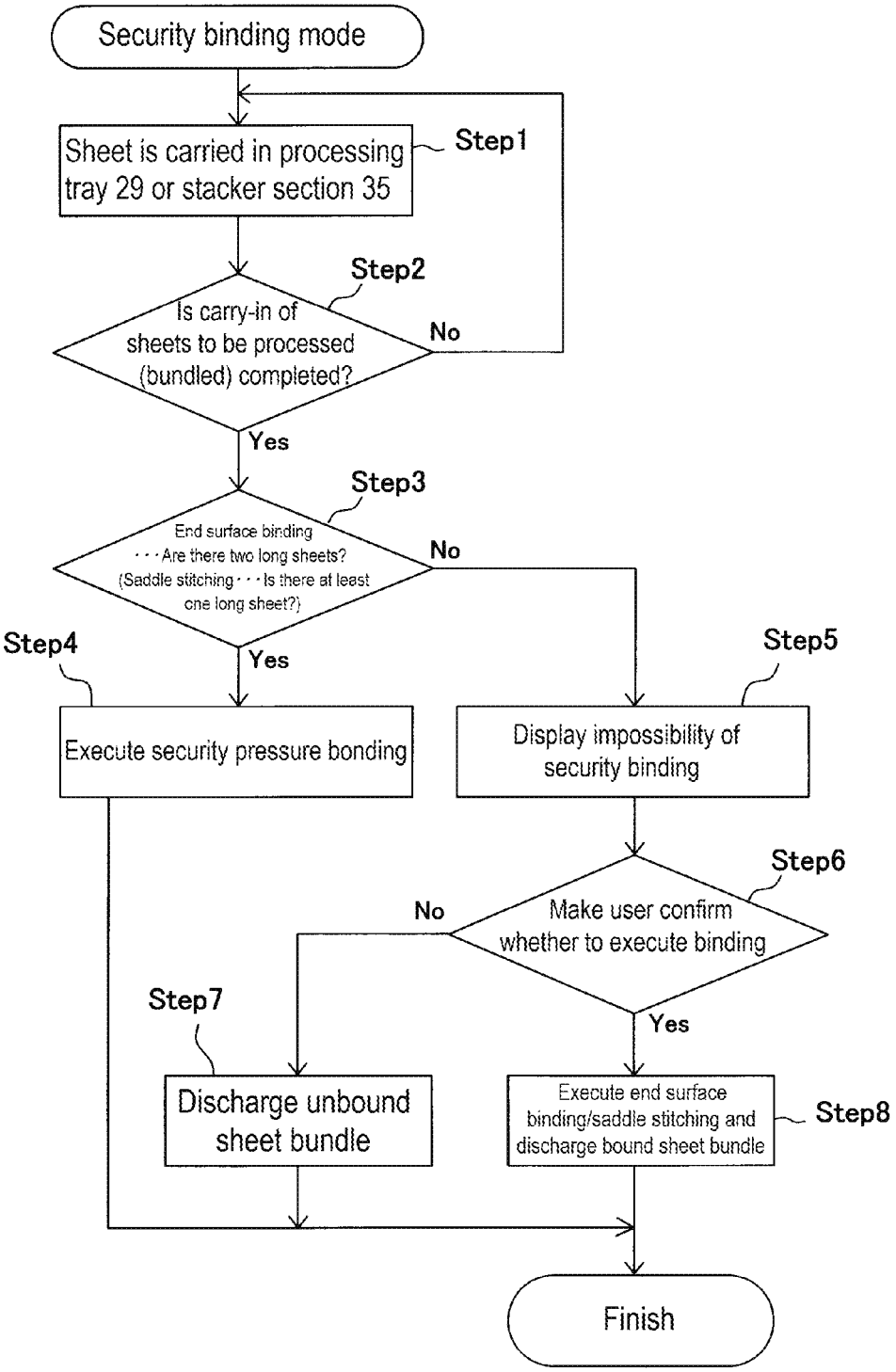
FIG. 25 is a view illustrating a flowchart for checking a sheet length in a security-binding mode that pressure-bonding binds a sheet end portion or the fore edge side of the sheet bundle.

First, as illustrated in FIG. 25, the security binding mode is set. The security binding mode is a mode that performs the temporary binding by pressure-bonding binding the leading end side or fore edge side of the sheet bundle using the end surface binding stapler unit 33 or saddle-stitching stapler unit 40 for ensuring security. Then, sheets are accommodated in the processing tray 29 (end surface binding) or stacker 35 (saddle-stitching) (step 1). Then, it is checked whether the number of sheets preset has been accumulated in the processing tray 29 or stacker 35. When the preset number is not reached, arrival of the following sheets are waited for (step S2).

When it is determined that all the sheets to be bound have been accommodated in the processing tray 29 or stacker 35, it is checked whether the pressure-bonding binding can be performed by determining whether there are at least two sheets each having the protruding portion in the case of the end surface binding on the processing tray 29. This is determined based on a detection time of the sensors S1 to S3 disposed in the first conveying path P1.

In the case of the saddle-stitching on the stacker 35, it is checked whether the pressure-bonding binding can be performed by determining whether there is at least one sheet having the protruding portion on both the stopper 38 side and leading end side in the conveying direction or whether there are at least two sheets having the protruding portion only one side in the conveying direction. This is determined based on a detection time of the sensors Psen1 to Psen3 disposed in the second conveying path P2 (step S3).

After confirming that the sheet having the protruding portion has been accommodated in the processing tray 29 or stacker 35 (YES) to enable the pressure-bonding binding, the temporary binding is performed by performing the pressure-bonding binding for ensuring security using the above-described end surface pressure-bonding binding unit 50 or folded sheet bundle pressure-bonding binding unit 70 (step 4).

On the other hand, when the sheet required for the press-bonding binding has not been accommodated in the processing tray 29, for example, when the sheet having the protruding portion (tab portion) has not been placed on the sheet placing table 1*c*, or when the sheet having a size equal to or smaller than that of the interleaves is placed and supplied, a signal indicating "security binding cannot be performed" is output and displayed as a notification on a display section of the image forming device or sheet processing device (step 5).

After output of the signal indicating "security binding cannot be performed", a user is asked whether or not the end surface binding by the staple needle 33*n* or saddle-stitching by the saddle-stitching staple needle 41*n* is performed (step 6). When it is determined that neither the end surface binding nor saddle-stitching is performed (No), the sheet bundle is discharged without execution of the sheet binding (step 7), and this routine is ended.

On the other hand, when it is determined that the end surface binding or saddle-stitching is performed (Yes), the staple-binding using the end surface binding stapler unit 33 or saddle-stitching stapler unit 40 is performed, and the resultant sheet bundle is discharged without execution of the pressure-bonding binding.

In the above step, when it is necessary to receive an instruction from the user, the sheet bundle is held as it is on the processing tray 29 or stacker 35 for a predetermined time to prompt the user to determine whether or not the binding is performed. Especially, for the sheets accumulated in the stacker 35, an alarm may be issued indicating that the sheet bundle is discharged after the elapse of a predetermined time if no instruction is made.

In the manner as described above, whether or not the pressure-bonding binding can be performed is determined by checking the sheet length in the sheet conveying path, whereby security ensuring reliability is enhanced.

[Operation of System Control Configuration]

The following describes a system control configuration of the above-described image forming device with reference to a block diagram of FIG. 26. The system for the image forming device illustrated in FIG. 1 includes a main body controller 101 for the image forming device A and a sheet processing controller 106 (control CPU) for the sheet processing device B. The main body controller 101 includes a print controller 102, a sheet supply controller 103, and an input section 104. A user sets a "print mode" or a "sheet processing mode" through a control panel 18 provided in the input section 104. In the print mode, print conditions such as a print copy count, a sheet size, color or black-and-white printing, enlarged or reduced printing, single- or double-side printing are set. Then, the main body controller 101 controls the print controller 102 and sheet supply controller 103 according to the set print conditions to print an image onto a predetermined sheet and sequentially carries out the resultant sheet through the main body discharge port 3.

At the same time, the user sets a sheet processing mode through the control panel 18. The sheet processing mode includes, for example, a "printout mode", a "staple-binding finishing mode", a "security binding mode", a "sheet bundle saddle-stitching mode", and a "security saddle-stitching mode". The main body controller 101 transfers, to the sheet processing controller 106, the set sheet processing mode, the number of sheets, copy number information, and information indicating whether to execute staple binding or security binding. Details of the above-mentioned modes will be described later.

The sheet processing controller 106 includes a control CPU that operates the sheet processing device B in accordance with the specified sheet processing mode, a ROM 107 that stores an operation program, and a RAM 108 that stores control data. The sheet processing controller 106 includes a sheet conveying controller 110 that executes conveyance of the sheet fed to the carry-in port 23, a punch drive controller 111 that uses the punch unit 28 to perform punch operation for the sheet, and an end surface binding controller 112 that uses the processing tray 29 to perform sheet storage operation and controls staple binding or pressure-bonding binding for security purpose and discharge of the bound sheet bundle.

Further, the sheet processing controller 106 includes a saddle stitching/center folding controller 113 that binds the sheet bundle accumulated in the stacker 35 and then fold the sheet bundle into two and a center-folded sheet security binding controller 114 that applies pressure-bonding control to the fore edge side of the saddle-stitched/folded sheet bundle for security and discharges the saddle-stitched/center-folded sheet bundle to the second discharge tray.

A connection between the controllers and sensors that detect the length of the conveyed sheet and motors has already been described in the embodiments of the above binding and folding operations and is roughly as illustrated in FIG. 26.

The sheet processing controller configured as described above makes the sheet processing device execute the following processing operation.

[Sheet Processing Mode]

As described above, in the sheet processing device B of the present embodiment, "printout mode", "staple-binding finishing mode", "security binding mode", "sheet bundle saddle-stitching mode", and "security saddle-stitching mode" can be set. The following roughly describes the above modes.

(1) Printout Mode

The printout mode is a mode to receive the image-formed sheet from the main body discharge port 3 of the image forming device A, and accommodate the received sheet in the first discharge tray 21.

(2) Staple-Binding Mode

The staple-binding mode is a mode to receive the image-formed sheets from the main body discharge port 3 by the processing tray 29, align the received sheets in a bundle, bind the aligned sheet bundle by the end surface binding stapler unit 33, and accommodate the bound sheet bundle in first discharge tray 21.

(3) Security Binding Mode

The security binding mode is a mode to receive the image-formed sheets from the main body discharge port 3 by the processing tray 29, align the received sheets in a bundle, bind the aligned sheet bundle by the end surface binding stapler unit 33, pressure-bonding bind the bound sheet bundle at the leading end on the discharge side by the end surface pressure-bonding binding unit 50, and accommodate the resultant sheet bundle in the first discharge tray 21.

(4) Sheet Bundle Saddle-Stitching Mode

The sheet bundle saddle-stitching mode is a mode, to receive the image-formed sheets from the main body discharge port 3 of the image forming device A by the stacker 35, align the received sheets in a bundle, staple-bind the aligned sheet bundle at a substantially center thereof in the sheet receiving direction by the saddle-stitching stapler unit 40, fold the staple-bound sheet bundle in a booklet form, and accommodate the resultant sheet bundle in the second discharge tray 22.

(5) Security Saddle-Stitching Mode

The security saddle-stitching mode is a mode to receive the image-formed sheets from the main body discharge port 3 by the stacker 35, align the received sheets in a bundle, saddle-stitch the aligned sheet bundle at a substantially center thereof in the sheet receiving direction by the saddle-stitching stapler unit 40, fold the saddle-stitched sheet bundle in a booklet form, pressure-bonding bind the folded sheet bundle at the booklet fore edge side by the folded sheet bundle pressure-bonding binding unit 70, and accommodate the resultant sheet bundle in the second discharge tray 22.

As described in the security mode flowchart of FIG. 25, in addition to the setting of above processing modes, the following setting can be made previously depending on whether the security binding can be performed or not. That is, when it is determined that the security binding can be performed, the security binding is executed; on the other hand, when it is determined that the security binding cannot be performed, the corresponding notification is issued, and a sheet bundle is discharged without any binding or discharged with only the end surface binding or saddle-stitching applied thereto.

The present invention in its preferred embodiments provides the following effects.

(1) There is provided a sheet processing device that binds sheets having different shapes and then folds the sheets, the sheet processing device including a receiving tray (stacker 35) capable of accommodating therein a sheet having a partially protruding portion and a sheet not having the protruding portion in a mixed state, a regulating member (stopper 38) that regulates a leading end of the sheet accommodated in the stacker 35, a first binding member (saddle-stitching stapler unit 40) that binds a sheet bundle regulated by the stopper 38 at a substantially center thereof in a sheet conveying direction, a folding section (folding roller 45 and folding blade 46) that folds the sheet bundle bound by the saddle-stitching stapler unit 40 in two, and a second binding member (folded sheet bundle pressure-bonding binding unit 70) that binds protruding portions of the sheet bundle (saddle-stitched sheet bundle NTS) folded by the folding section on a fore edge side of the sheet bundle.

With this configuration, the fore edge side of the saddle-stitched/folded sheet bundle can be bound by temporary binding, so that the security of the saddle-stitched sheet bundle can be ensured.

(2) In the sheet processing device of (1), the sheet having the protruding portion at a part thereof is a sheet having a tab at least in the sheet conveying direction.

With this configuration, the tab portion which is a partially protruding portion is temporarily bound, so that the tab portion can easily be cut off after completion for actual use.

(3) The sheet processing device of (2) further includes a pressing member (bundle pressing roller 90) that presses the folded sheet bundle from a thickness direction of the sheet bundle when pressure-bonding binding is performed by the folded sheet bundle pressure-bonding binding unit 70.

With this configuration, a displacement or a shift of the sheet bundle can be prevented when the pressure-bonding binding (temporary binding) for ensuring security is performed.

(4) In the sheet processing device of (3), the bundle pressing roller 90 is constituted of a roller pair and configured to convey the saddle-stitched sheet bundle NTS in a sheet discharge direction and to press the sheet bundle with a larger force than that at the conveying time when the binding is performed using the folded sheet bundle pressure-bonding binding unit 70.

With this configuration, the sheet bundle can be held at the binding time by the roller for moving the sheet bundle.

(5) In the sheet processing device of (4), the sheet with tab is positioned at the outermost side of the sheet bundle to be folded.

With this configuration, the sheet with tab is positioned at the outermost side, the security of all the sheets of the sheet bundle to be folded can easily be ensured.

(6) In the sheet processing device of (4), the sheets with tab are inserted between sheets without tab so as to sandwich the sheets without tab therebetween, and the resultant sheet bundle is accommodated in the stacker 35.

With this configuration, the security of an arbitrary number of sheets sandwiched by the sheets with tab can be ensured.

(7) In the sheet processing device of (5), the saddle-stitching stapler unit 40 is constituted of a staple-binding member that binds a sheet bundle using a saddle-stitching staple needle 41*n*, and the folded sheet bundle pressure-bonding binding unit 70 is constituted of a pressure-bonding binding member that pressure-bonds a sheet bundle from a sheet thickness direction without using a staple needle to bind the sheet bundle.

With this configuration, security binding for the saddle-stitched sheet is achieved by the pressure-bonding binding. Thus, once the pressure-bonded portion is torn, the original state cannot be easily restored, whereby security can be ensured. Further, the pressure-bonded portion can easily be torn for actual use.

(8) There is provided a sheet processing device including a processing tray 29 that accommodates, in a mixed state, sheets and sheets having a protruding portion (TTSL or TTS_TAB) protruding from the sheet, an aligning member 31 that aligns the mixed sheets accommodated in the processing tray 29, an end surface binding stapler unit 33 that binds the mixed sheets accommodated with the sheets sandwiched between the sheets having the protruding portion, an end surface pressure-bonding binding unit 50 that binds the protruding portions of the sheet bundle bound by the end surface binding stapler unit 33, detection members (sensors S1, S2, and S3) that detect presence/absence of the protruding portion of the sheets to be conveyed to the processing tray 29, and a controller (sheet processing controller 106) that issues an alarm signal when the sensors detect that the sheet having the protruding portion is not accommodated in the processing tray 29 in a security binding mode in which the mixed sheets are bound by the end surface binding stapler unit 33 and then the protruding portions of the bound sheet bundle are bound by the end surface pressure-bonding binding unit 50.

With this configuration, it is detected that there is no sheet having the protruding portion that should originally exist before the binding processing, followed by issuance of an alarm signal, so that a more reliable security measure can be taken.

(9) In the sheet processing device of (8), the first binding member is an end surface binding stapler unit 33 positioned on a regulation reference side of the processing tray 29 in a sheet conveying direction and binds a sheet bundle by a staple needle 33*n*, and the second binding member is an end surface pressure-bonding binding unit 50 positioned at an opposite side of the end surface binding stapler unit 33 in a sheet discharge direction and binds the protruding portions of the sheet bundle by applying pressure-bonding without using the staple needle.

With this configuration, temporary binding for ensuring security is performed by the pressure-bonding binding unit, so that once the pressure-bonded portion is torn, the original state cannot be easily restored, whereby a booklet with ensured security can be provided. Further, the pressure-bonded portion can easily be torn for actual use.

(10) In the sheet processing device of (9), when no or only one sheet having the protruding portion on the sheet discharge side of the processing tray 29 exists, an alarm signal is issued.

With this configuration, when there are no sheets that sandwich interleaves on the processing tray 29, an alarm indicating that temporary binding for ensuring security cannot be performed is issued, so that security can be ensured more reliably.

(11) In the sheet processing device of (9), a subsequent operation is not executed during a time from when the alarm signal is issued to a time when the sheets are removed from the processing tray 29.

With this configuration, a fact that security cannot be ensured is notified by an alarm and operation, so that security can be ensured more reliably.

(12) In the sheet processing device of (9), after issuance of the alarm signal, the sheets are discharged from the processing tray 29 without execution of sheet binding.

With this configuration, the sheets are discharged without execution of sheet binding after issuance of the alarm, so that a fact that security is not ensured becomes more clear.

(13) In the sheet processing device of (9), after issuance of the alarm signal, the sheet bundle is bound by the end surface binding stapler unit 33 and then discharged from the processing tray 29.

With this configuration, the sheet bundle is subjected to only needle binding and then discharged, so that sheets are not scattered.

(14) There is provided a sheet processing device that binds sheets having different shapes and then folds the sheets, the sheet processing device including a stacker 35 capable of accommodating therein a sheet having, at a part thereof, a protruding portion (NTSL or NTS_TAB) and a sheet not having the protruding portion in a mixed state, a stopper 38 that regulates a leading end of the sheet accommodated in the stacker 35, a saddle-stitching stapler unit 40 that binds a sheet bundle regulated by the stopper 38 at a substantially center thereof in a sheet conveying direction, a folding roller 45 and a folding blade 46 that fold the sheet bundle staple-bound by the saddle-stitching stapler unit 40 in two, a folded sheet bundle pressure-bonding binding unit 70 that binds protruding portions (NTSL or NTS_TAB) of the sheet bundle folded by the folding roller 45 and folding blade 46 on a fore edge side of the sheet bundle, sensors Psen1, Psen2, and Psen3) that detect presence/absence of the protruding portion of the sheets to be conveyed to the stacker 35, and a sheet processing controller 106 that issues an alarm signal when the sensors Psen1, Psen2, and Psen3 detect that the sheet having the protruding portion (NTSL or NTS_TAB) is not accommodated in the stacker 35 in a mode (security mode) in which the mixed sheets are bound by the saddle-stitching stapler unit 40, and folded, and the protruding portions (NTSL or NTS_TAB) of the resultant sheet bundle are bound by the folded sheet bundle pressure-bonding binding unit 70.

With this configuration, an alarm indicating that the security of the saddle-stitched sheet bundle cannot be ensured is issued, so that security is enhanced.

(15) In the sheet processing device of (14), after issuance of the alarm signal, the sheets are discharged from the stacker 35 after being folded without execution of sheet binding.

With this configuration, the sheets are discharged without execution of saddle-stitching after issuance of the alarm, so that a fact that security is not ensured becomes more clear.

(16) In the sheet processing device of (14), after the issuance of the alarm signal, the sheet bundle is bound by the saddle-stitching stapler unit 40, folded, and then discharged from the processing tray 29.

With this configuration, the sheet bundle is subjected to only saddle-stitching and then discharged, so that sheets are not scattered.

(17) An image forming device comprising:

a print section 2 serving as an image forming section that sequentially forms an image onto sheets; and a sheet processing device that applies predetermined processing onto the sheets from the print section 2, wherein the sheet processing device has a configuration as described in any one of the above (1) to (16).

With this configuration, there can be provided an image forming device having effects described in the above (1) to (16).

In the description of the effects of the embodiments, parentheses are used to enclose the constituent elements recited in the claims or reference numerals are given thereto so as to clarify a correspondence relationship between the description of "Detailed Description" and the description of "What is Claimed is".

Further, it should be appreciated that the present invention is not limited to the above-described embodiments, and various modifications may be made thereto. Further, all the technical matters included in the technical ideas set forth in the claims should be covered by the present invention. While the invention has been described based on preferred embodiments, those skilled in the art can realize various substitutions, corrections, modifications, or improvements from the content disclosed in the specification, which are included in the scope defined by the appended claims.

This application is based upon and claims the benefit of priority from prior Japanese Patent Applications No. 2015-134848, No. 2015-134849, and No. 2015-134847, all filed Jul. 6, 2015, the entire contents of which are incorporated herein by reference.

What is claimed is:

1. A sheet processing device that binds sheets having different shapes and then folds the sheets, comprising:

a receiving tray capable of accommodating therein a sheet having a protruding portion at a part thereof and a sheet not having the protruding portion in a mixed state;

a regulating member that regulates a leading end of the sheet accommodated in the receiving tray;

a first binding member that binds a sheet bundle regulated by the regulating member at a substantially center thereof in a sheet conveying direction with a staple needle;

a folding section that folds the sheet bundle bound by the first binding member in two;

a second binding member that applies a pressure from a thickness direction of the sheet bundle to deform and performs a pressure-bonding binding on protruding portions of the sheet bundle folded by the folding section on a fore edge side of the sheet bundle;

a detection member that detects presence or absence of the protruding portion of the sheets to be conveyed to the receiving tray; and a controller that issues an alarm signal when the detection member detects the sheet having the protruding portion is not accommodated in the receiving tray in a mode in which the first binding member is configured to bind the mixed sheets and after the mixed sheets are folded, the second binding member is configured to bind the protruding portions of the resultant sheet bundle.

2. The sheet processing device according to claim 1, wherein the sheet having the protruding portion at a part thereof is a sheet having a tab at least in the sheet conveying direction, and the sheet is accompanied in the receiving tray.

3. The sheet processing device according to claim 2, further comprising a pressing member that is disposed downstream of the folding section in the sheet conveying direction and presses the folded sheet bundle from the thickness direction of the sheet bundle when the pressure-bonding binding is performed by the second binding member.

4. The sheet processing device according to claim 3, wherein the pressing member is constituted of a roller pair and configured to convey a saddle-stitched sheet bundle in a sheet discharge direction and to press the sheet bundle with a larger force than that at a conveying time when the binding is performed by the second binding member.

5. The sheet processing device according to claim 4, wherein the sheet with the tab is positioned at an outermost side of the sheet bundle to be folded.

6. The sheet processing device according to claim 4, wherein the sheets with the tabs are inserted between sheets without the tabs so as to sandwich the sheets without the tabs therebetween, and the resultant sheet bundle is accommodated in the receiving tray.

7. The sheet processing device according to claim 1, wherein after the issuance of the alarm signal, the sheets are discharged from the receiving tray after being folded without execution of sheet binding by the first or second binding member.

8. The sheet processing device according to claim 1, wherein after the issuance of the alarm signal, the sheet bundle is bound by the first binding member, folded, and then discharged from the receiving tray without execution of sheet binding by the second binding member.

9. An image forming device comprising:

an image forming section that sequentially forms an image onto sheets; and a sheet processing device that applies predetermined processing onto the sheets from the image forming section, wherein the sheet processing device has a configuration as claimed in claim 1.

10. The sheet processing device according to claim 3, wherein the pressing member comprises a roller pair and configured to convey a saddle-stitched sheet bundle in a sheet discharge direction and to stop a conveyance of the sheet bundle when the binding is performed by the second binding member.

* * * * *